US009841222B2

(12) United States Patent
Im et al.

(10) Patent No.: US 9,841,222 B2
(45) Date of Patent: Dec. 12, 2017

(54) REFRIGERATOR

(71) Applicant: LG ELECTRONICS INC., Seoul (KR)

(72) Inventors: Jihyun Im, Seoul (KR); Jindong Kim, Seoul (KR); Hyunbum Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/898,411

(22) PCT Filed: Jun. 16, 2014

(86) PCT No.: PCT/KR2014/005246
§ 371 (c)(1),
(2) Date: Dec. 14, 2015

(87) PCT Pub. No.: WO2014/200315
PCT Pub. Date: Dec. 18, 2014

(65) Prior Publication Data

US 2016/0131413 A1 May 12, 2016

(30) Foreign Application Priority Data

Jun. 14, 2013 (KR) ..... 10-2013-0068183
Jun. 14, 2013 (KR) ..... 10-2013-0068235

(51) Int. Cl.
*F23D 23/00* (2006.01)
*F25D 23/02* (2006.01)
(Continued)

(52) U.S. Cl.
CPC ..... *F25D 23/028* (2013.01); *E05D 7/04* (2013.01); *E05D 15/00* (2013.01); *F25D 23/025* (2013.01);
(Continued)

(58) Field of Classification Search
CPC ..... A47B 96/02; A47B 96/024; A47B 96/027; A47B 96/028; A47B 96/061;
(Continued)

(56) References Cited

U.S. PATENT DOCUMENTS 2,129,923 A 9/1938 Mortimer
8,147,015 B2 4/2012 Kim
(Continued)

FOREIGN PATENT DOCUMENTS

EP 2 565 565 A2 3/2013
KR 20130030111 3/2013

OTHER PUBLICATIONS

International Search Report dated Oct. 28, 2014 for Application No. PCT/ KR2014/005246, 3 Pages.
(Continued)

*Primary Examiner* — Janet M Wilkens
(74) *Attorney, Agent, or Firm* — Fish & Richardson P.C.

(57) ABSTRACT

A refrigerator includes a cabinet with a first storage region sealable by a gasket of a door. A first hinge, outside a sealing region, allows the door to rotate relative to the cabinet. A second hinge, inside the sealing region, allows the door to rotate relative to a container having a second storage region that can be accommodated inside the first storage region. Rotating shafts of the first and second hinges are non-collinear, and a coupling between the container and the second hinge is drawn forward when the door rotates independent of the container. A guide unit protrudes into the first storage region and is selectively coupled to a fixing device at the container. The fixing device includes a push unit pushable by the door and a holder that fixes the guide unit as a rotation axis of the container, and releases the push unit from a pushed state.

14 Claims, 17 Drawing Sheets

(51) Int. Cl.

| | |
|---|---|
| ***E05D 7/04*** | (2006.01) |
| ***E05D 15/00*** | (2006.01) |
| ***F25D 23/04*** | (2006.01) |
| ***F25D 25/00*** | (2006.01) |

(52) U.S. Cl.
CPC ..... *F25D 23/04* (2013.01); *F25D 25/00* (2013.01); *F25D 2201/10* (2013.01); *F25D 2323/024* (2013.01)

(58) Field of Classification Search
CPC ... A47B 96/066; A47B 96/068; F25D 23/028; F25D 23/04; F25D 23/02; F25D 23/025; F25D 29/005; Y10S 292/21; Y10S 292/71; Y10S 292/552; Y10S 292/143
USPC ..... 312/236, 405, 321.5, 405.1
See application file for complete search history.

(56) References Cited

U.S. PATENT DOCUMENTS 8,752,918 B2 * 6/2014 Kang ..... F25D 23/025 312/405.1
9,267,727 B2 * 2/2016 Lim ..... F25D 23/028
2013/0033163 A1 2/2013 Kang
2013/0049562 A1 * 2/2013 Jung ..... F25D 23/028 312/405
2014/0203695 A1 * 7/2014 Oh ..... F25D 23/02 312/326
2014/0232251 A1 * 8/2014 Kim ..... F25D 23/028 312/404
2015/0137674 A1 * 5/2015 Choi ..... F25D 23/04 312/404
2015/0233629 A1 * 8/2015 Choi ..... F25D 23/04 312/404
2016/0138855 A1 * 5/2016 Choo ..... E05B 47/06 312/405.1
2016/0145917 A1 * 5/2016 Kim ..... E05B 65/0042 312/405
2016/0146529 A1 * 5/2016 Choi ..... F25D 23/062 312/404

OTHER PUBLICATIONS

Extended European Search Report in European Application No. 14811487.9-1605/3008409, dated Feb. 2, 2017, 8 pages (with English translation).

* cited by examiner

[Fig. 1]
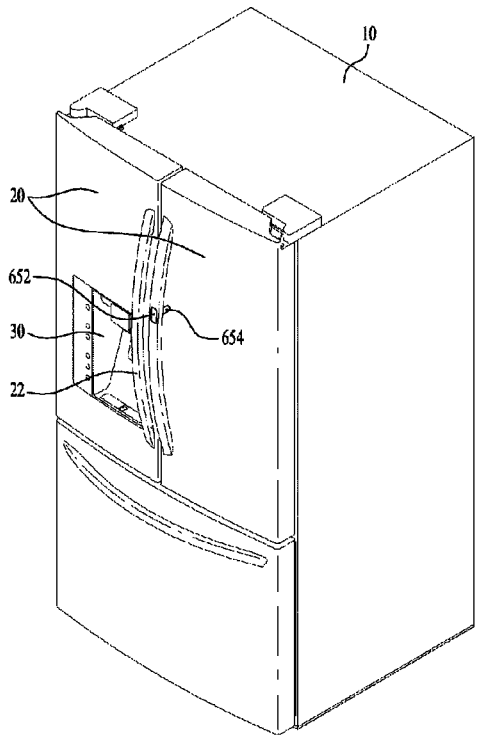
[Fig. 2]
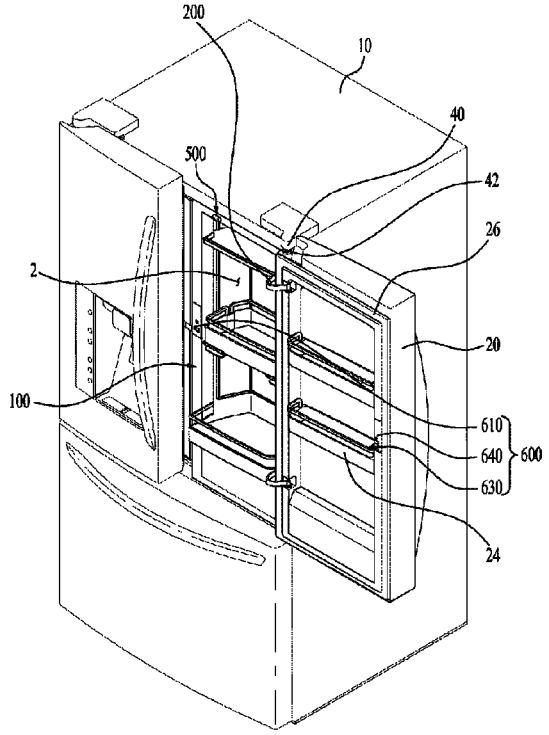

[Fig. 3]
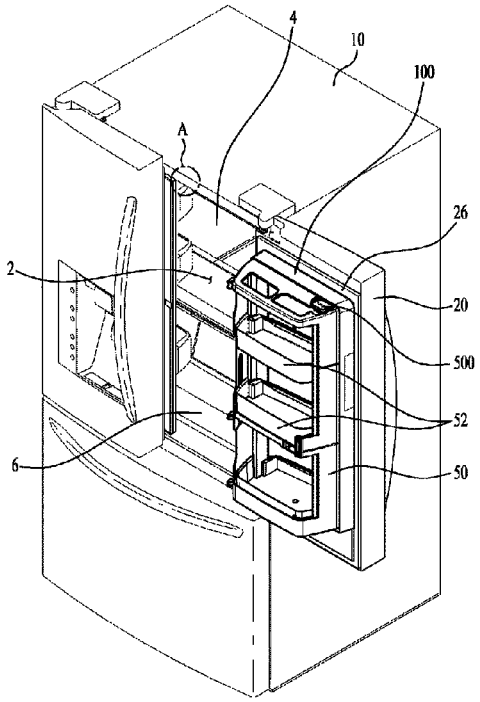
[Fig. 4]
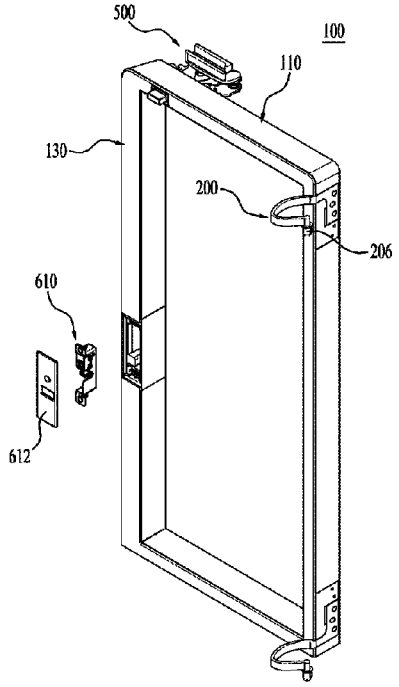

[Fig. 5]
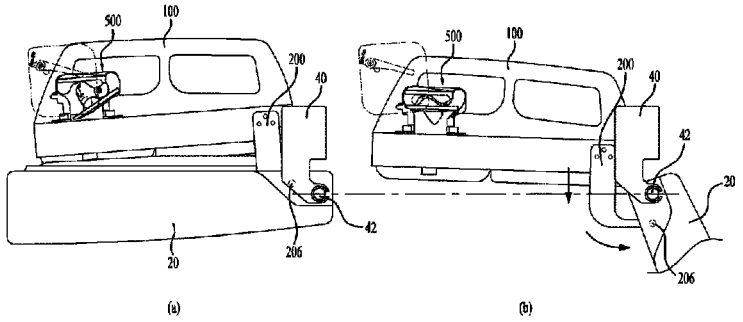
[Fig. 6]
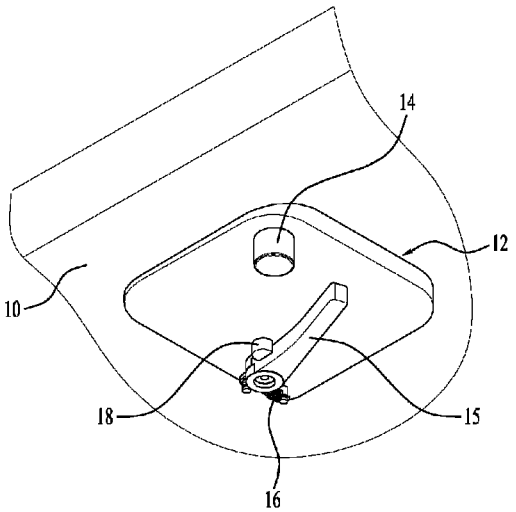
[Fig. 7]
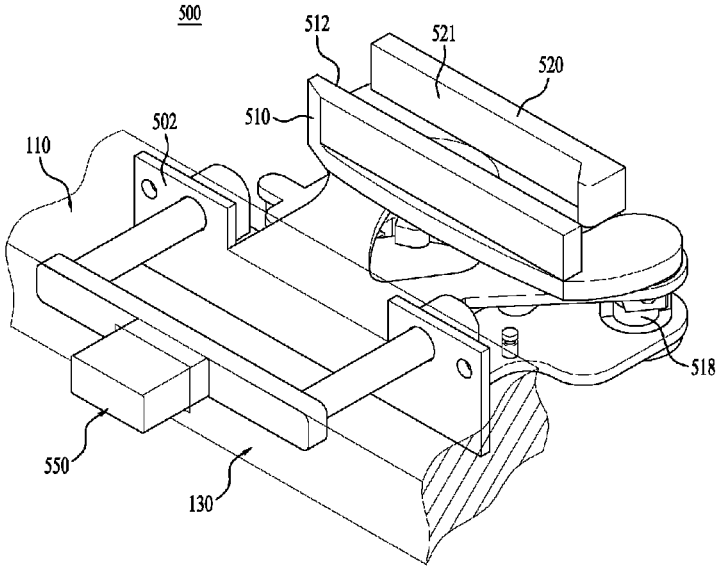

[Fig. 8]
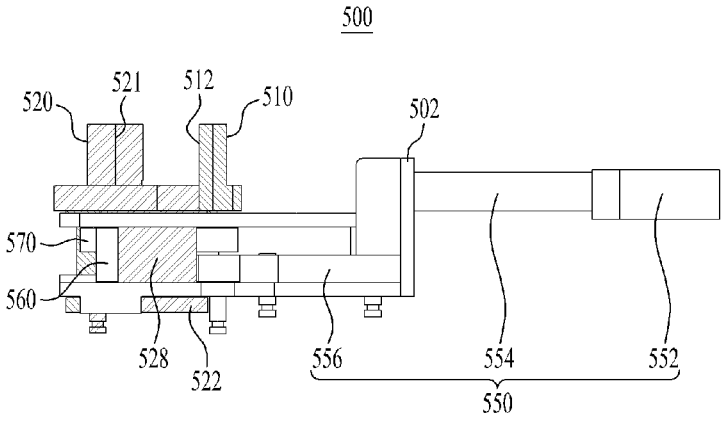
[Fig. 9]
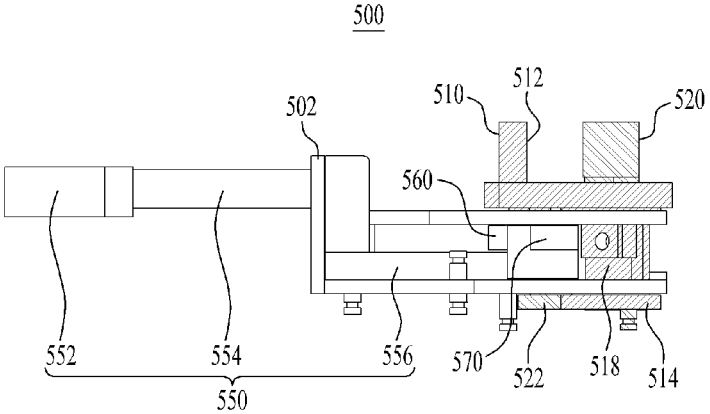

[Fig. 10]
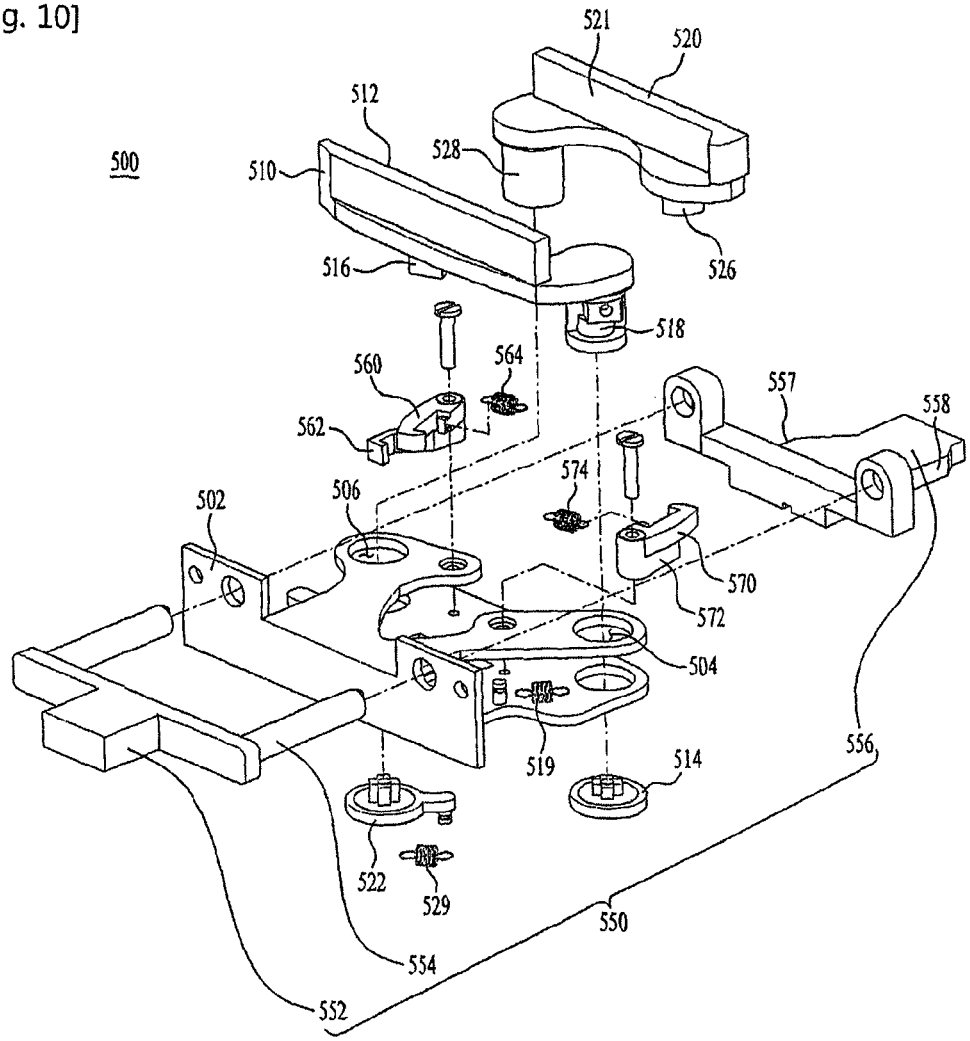

[Fig. 11]
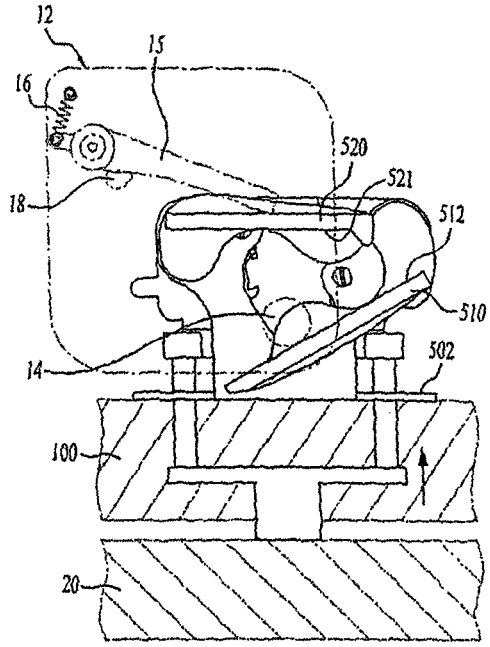
(a)
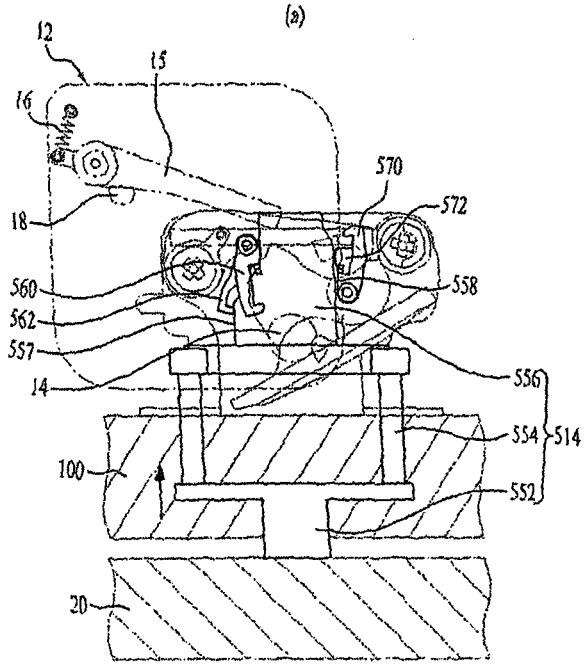
(b)

[Fig. 12]
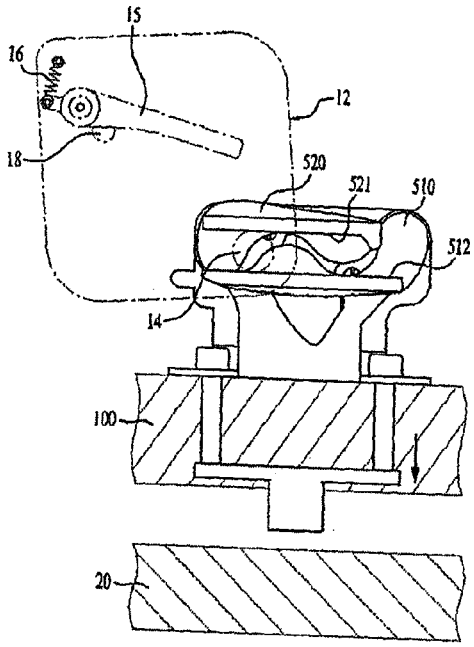
(a)
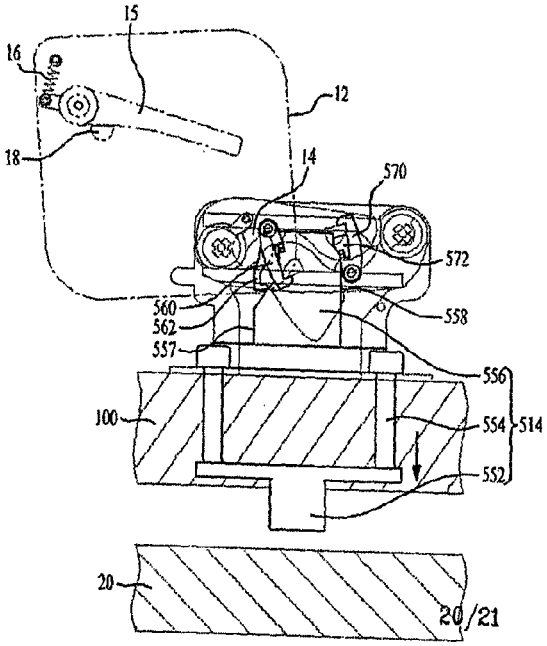
(b)

[Fig. 13]
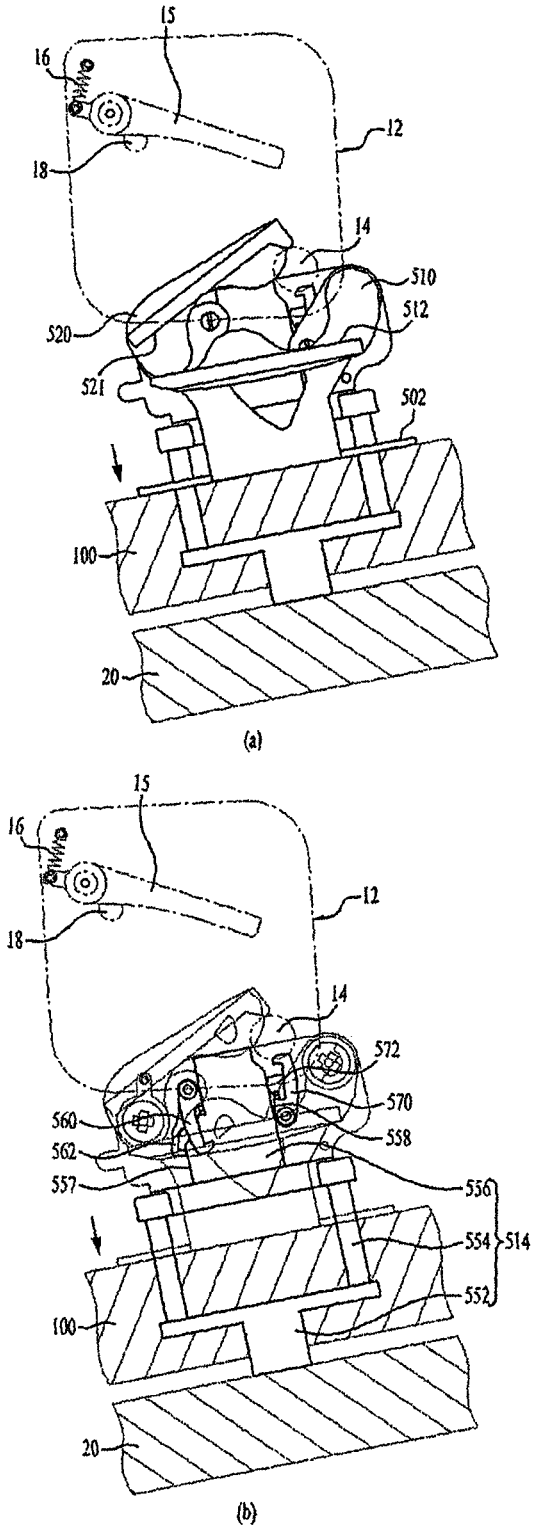

[Fig. 14]
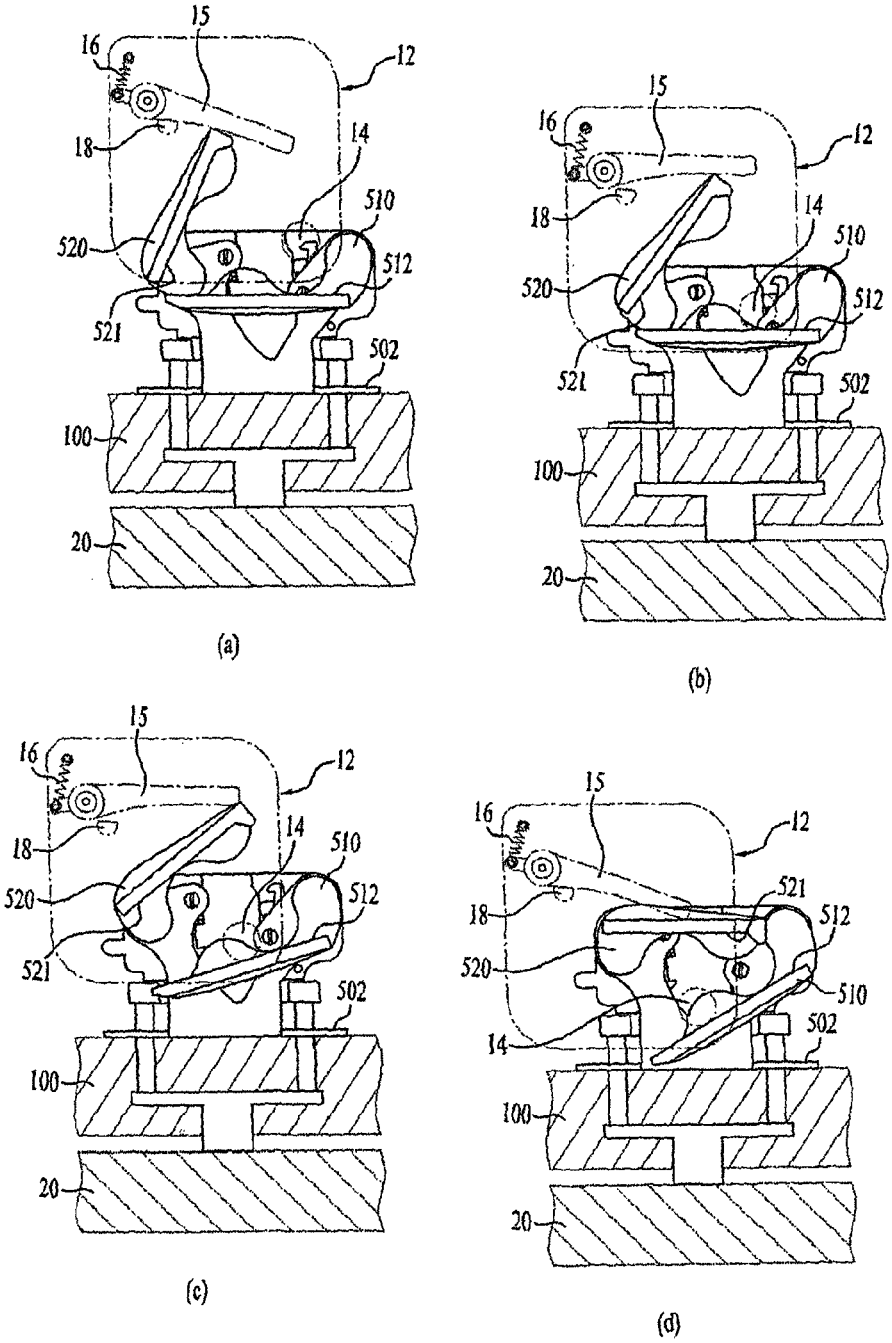

[Fig. 15]
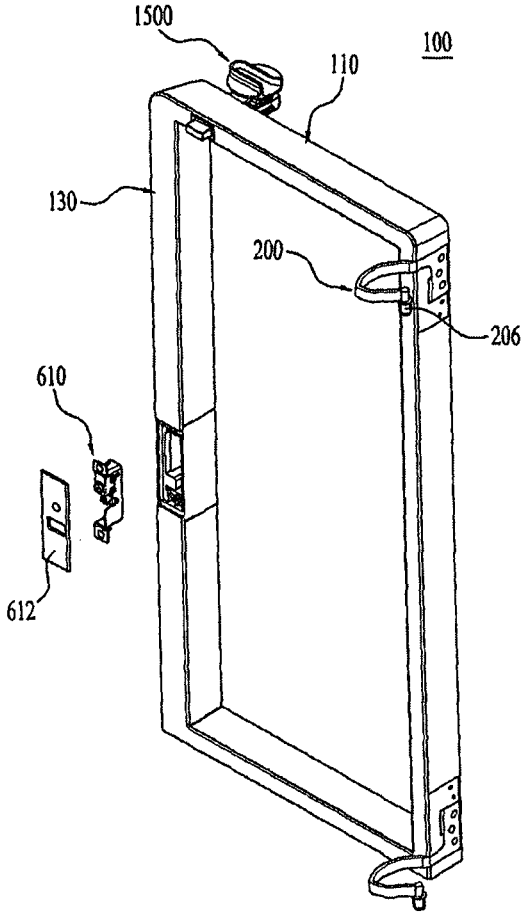

[Fig. 16]
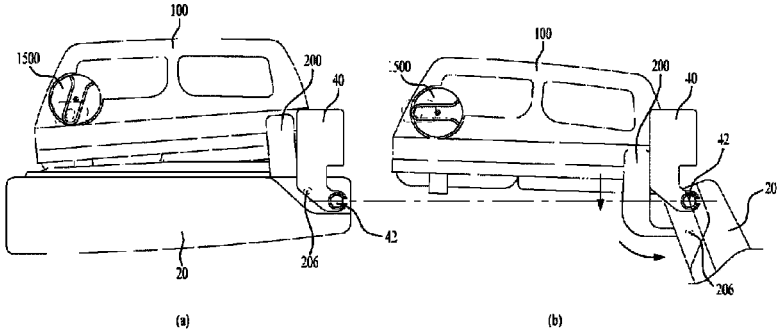
[Fig. 17]
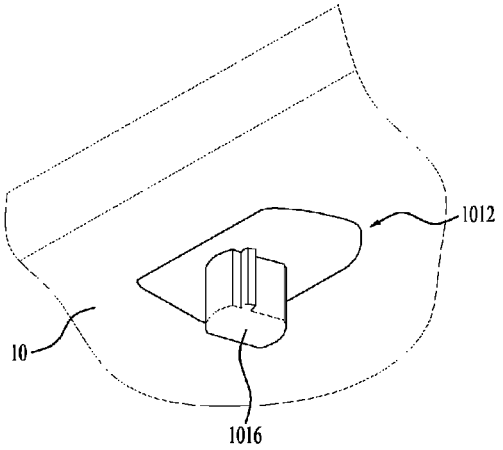
[Fig. 18]
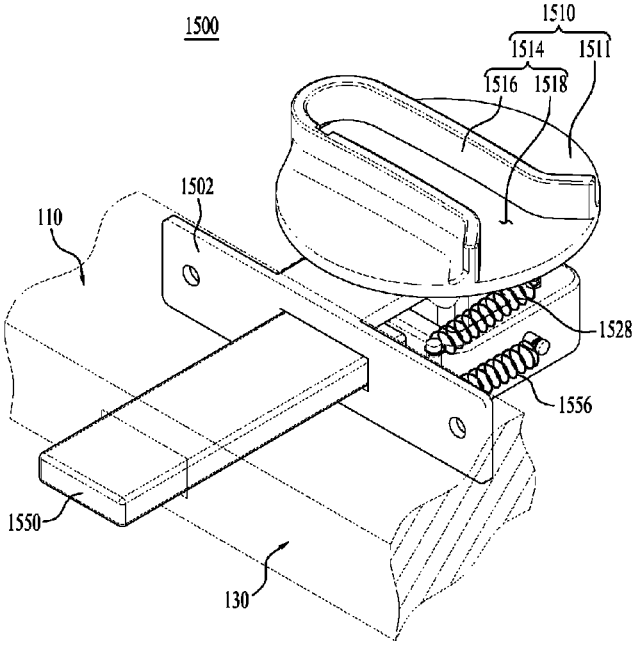

[Fig. 19]
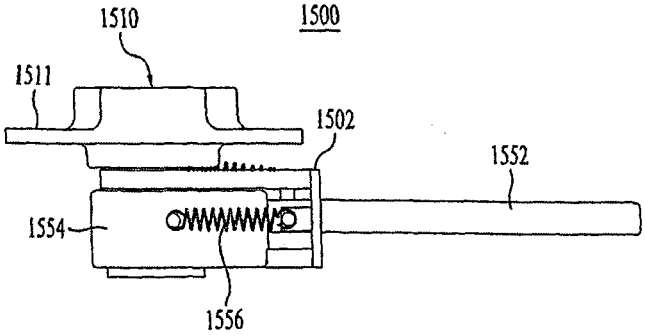
[Fig. 20]
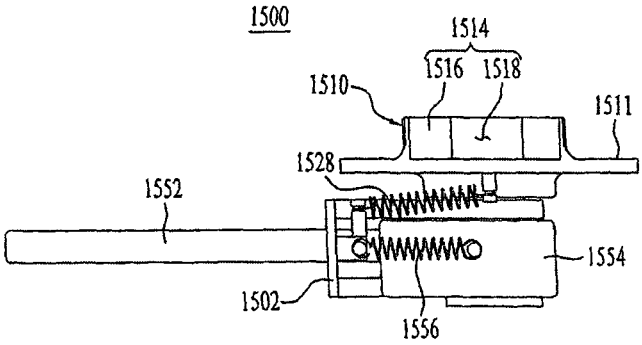

[Fig. 21]
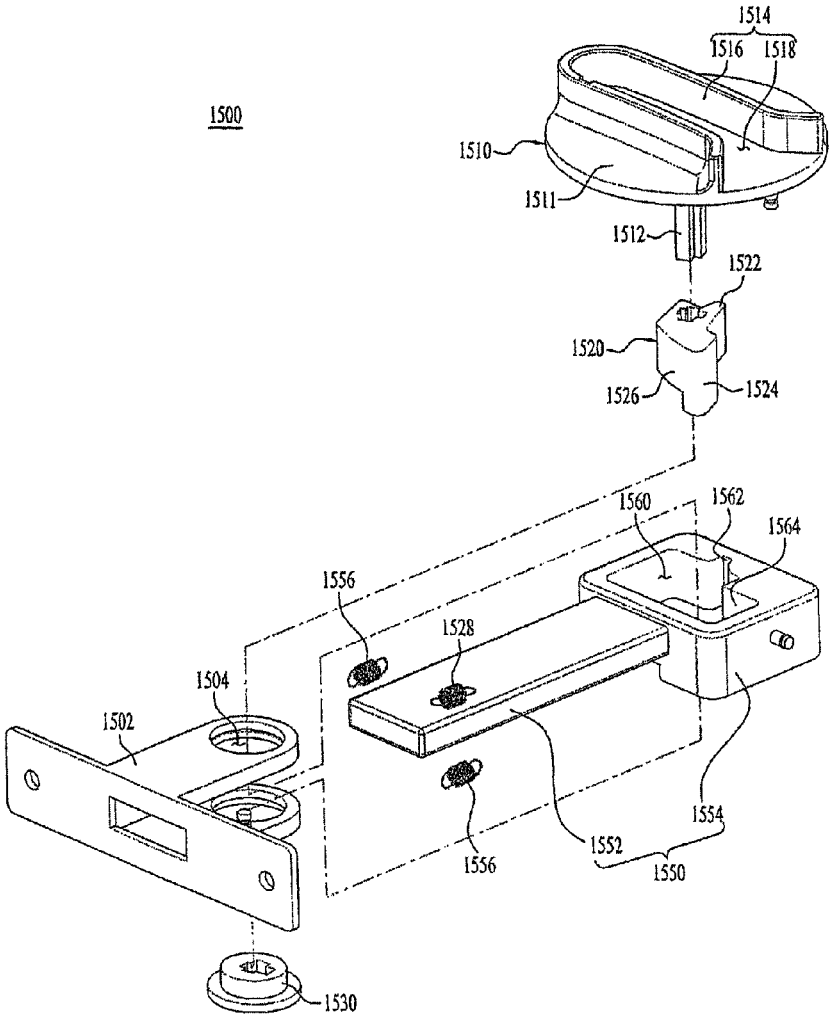

[Fig. 22]
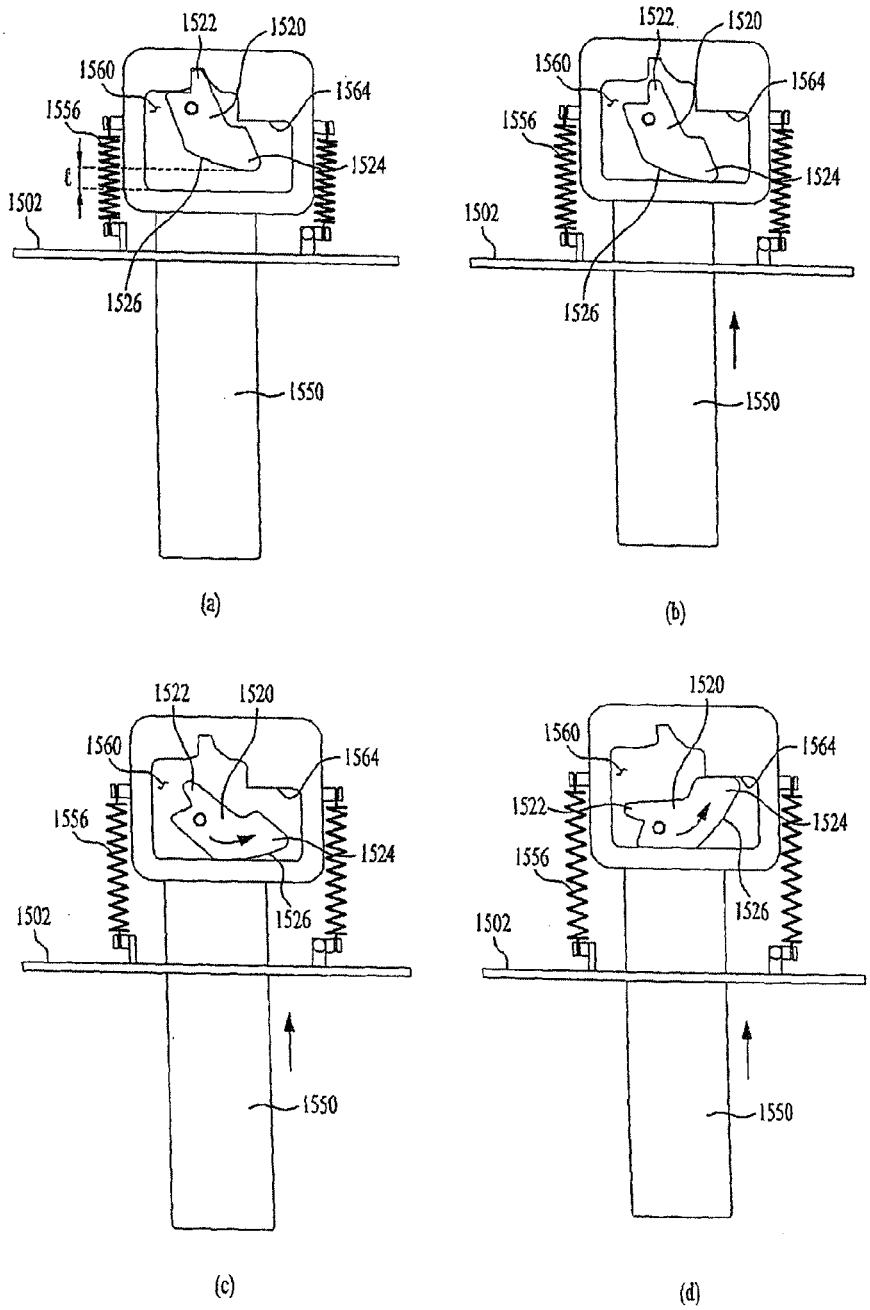

[Fig. 23]
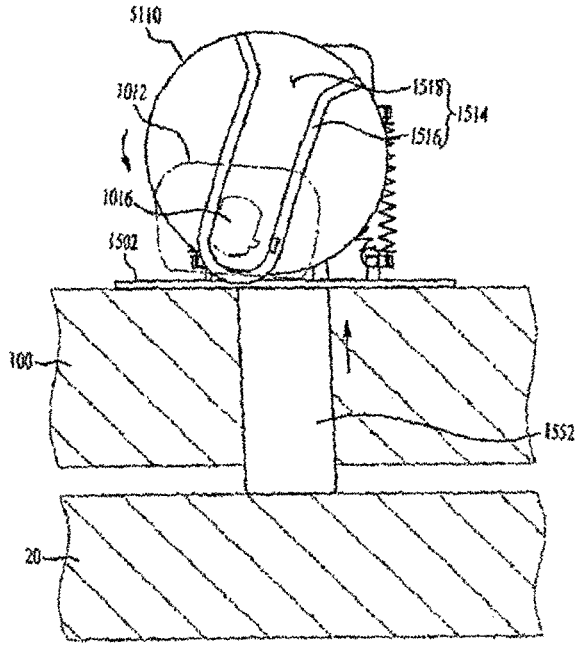
(a)
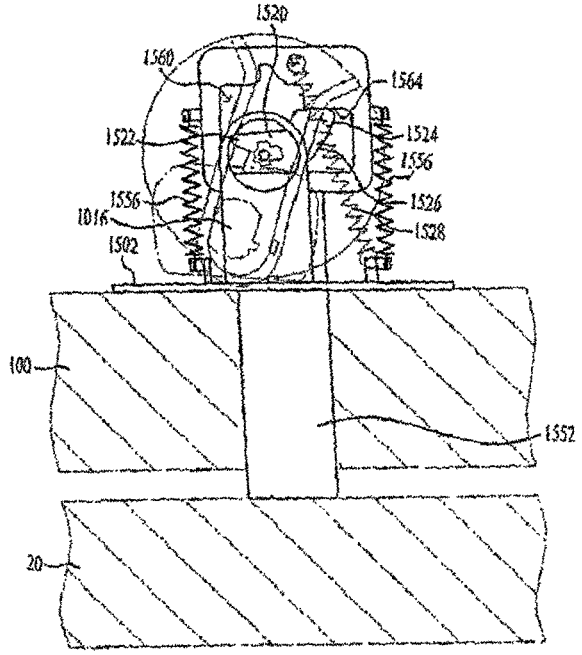
(b)

[Fig. 24]
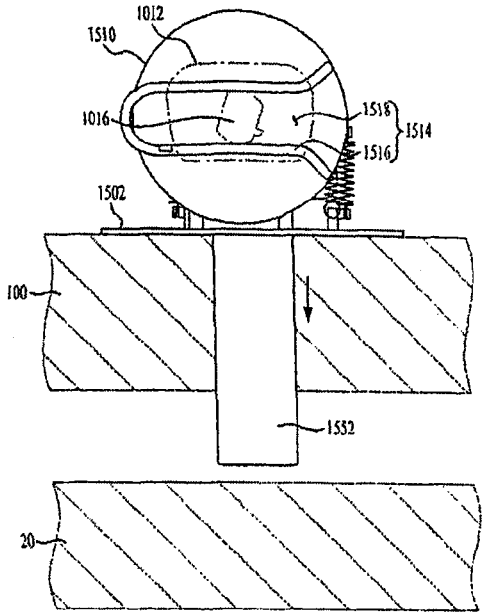
(a)
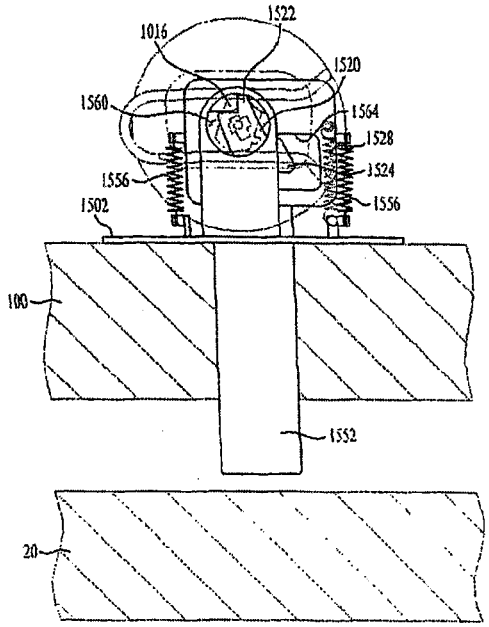
(b)

[Fig. 25]
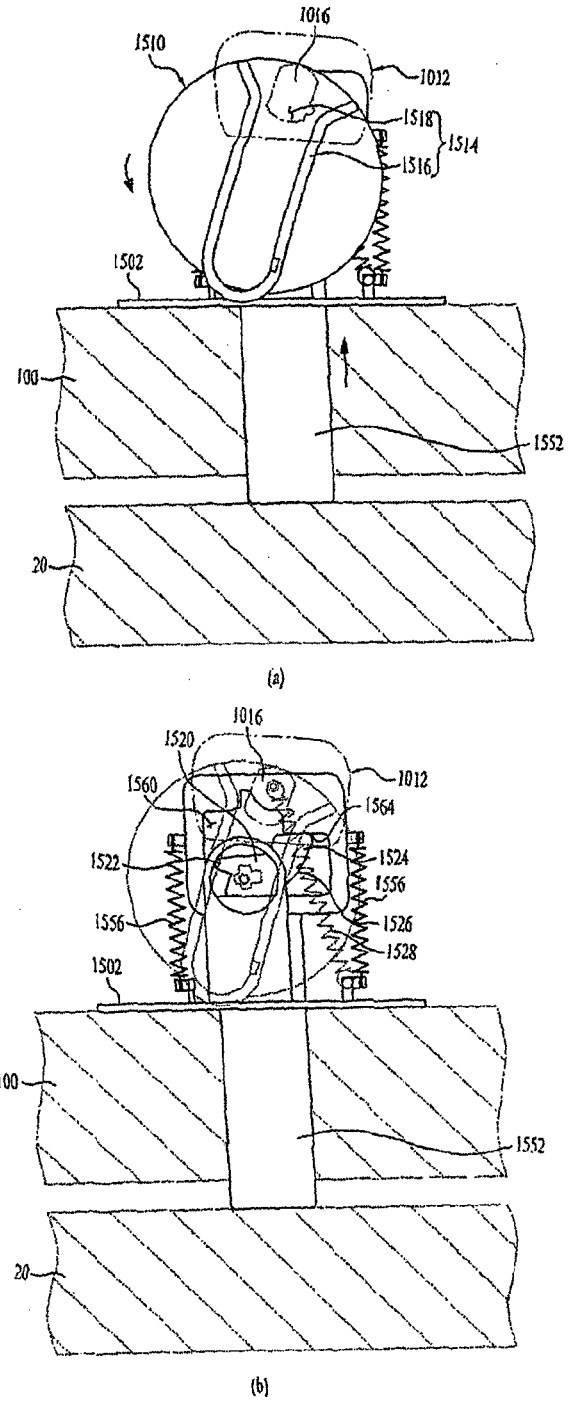

REFRIGERATOR

CROSS REFERENCE TO RELATED APPLICATIONS

This application is a U.S. National Phase Application under 35 U.S.C. §371 of International Application PCT/KR2014/005246, filed on Jun. 16, 2014, which claims the benefit of Korean Application Nos. 10-2013-0068235, and 10-2013-0068183 filed on Jun. 14, 2013, the entire contents of which are hereby incorporated by reference in their entireties.

TECHNICAL FIELD

The present invention relates to a refrigerator and, more particularly, to a refrigerator in which a container may be stably fixed to a cabinet when a door is rotated separately from the container.

BACKGROUND ART

In general, a refrigerator is an apparatus that stores food and the like refrigerated or frozen as cold air, generated by a refrigeration cycle consisting of a compressor, a condenser, an expansion valve, an evaporator and the like, is circulated to lower an interior temperature of a food storage space.

Such a refrigerator generally includes a freezing compartment in which food or beverages are kept frozen and a refrigerating compartment in which food or beverages are kept at a low temperature.

Refrigerators may be classified into a top mount type refrigerator in which the freezing compartment is located above the refrigerating compartment, a bottom freezer type refrigerator in which the freezing compartment is located below the refrigerating compartment and a side by side type refrigerator in which the freezing compartment and the refrigerating compartment are left and right compartments divided by a partition.

These refrigerators implement cooling of a storage compartment, such as the freezing compartment or the refrigerating compartment, using cold air generated by heat exchange between air and refrigerant circulating through the refrigeration cycle. Accordingly, the interior of the storage compartment defined in the refrigerator is usually kept at a lower temperature than a temperature of the outside.

The freezing compartment and the refrigerating compartment are defined in a cabinet that forms an external appearance of the refrigerator and are selectively opened or closed by a freezing compartment door and a refrigerating compartment door respectively. The freezing compartment door and the refrigerating compartment door are pivotally rotatably mounted to the freezing compartment and the refrigerating compartment which have open front sides. Each door is provided with a gasket to hermetically seal the interior of the storage compartment.

In recent years, to satisfy various consumer demands and to prevent loss of cold air caused by frequent door opening/closing, technologies in which an auxiliary door is installed between the cabinet and the refrigerating compartment or freezing compartment door and a storage container is installed to the auxiliary door have been developed.

However, due to the fact that the freezing compartment or refrigerating compartment door and the auxiliary door are provided with gaskets respectively, loss of cold air through the two gaskets may be increased beyond that in the case in which a single gasket is provided without the auxiliary door.

In addition, dew formation due to a temperature difference between the interior and the exterior may occur at gasket contact regions, i.e. at a front surface of the cabinet and a front surface of the freezing compartment or refrigerating compartment door. To prevent this dew formation, it is necessary to mount respective heaters in the aforementioned two regions to heat the regions. In this case, two heaters for prevention of dew formation may be required, which may cause increased power consumption.

In addition, since the freezing compartment or refrigerating compartment door may be opened or closed independently of the auxiliary door, there is a need for a structure to stably fix the auxiliary door to the cabinet upon opening or closing of the refrigerating compartment or freezing compartment door.

DISCLOSURE OF INVENTION

Technical Problem

The present invention is directed to solving the above-described problems and one object of the present invention is to provide a fixing device which may stably fix a container to a cabinet when a door is rotated separately from the container and a refrigerator having the same.

Another object of the present invention is to provide a fixing device which may allow a container to be moved toward a user when a door is rotated alone and a refrigerator having the same.

Solution to Problem

In accordance with one embodiment of the present invention, there is provided a refrigerator including a cabinet configured to define a first storage region in which food is stored, a door configured to open or close the first storage region, a gasket provided at the door to seal the first storage region, a first hinge located at the outside of a sealing region, the sealing region being defined by the gasket, one side of the first hinge being fixed to the cabinet and the other side of the first hinge being rotatably connected to the door, a container configured to define a second storage region, the container being received in the first storage region, a second hinge located inside the sealing region, one side of the second hinge being fixed to the container and the other side of the second hinge being rotatably connected to the door, a guide unit configured to protrude into the first storage region, and a fixing device provided at the container, the fixing device being selectively coupled to or released from the guide unit, wherein the first hinge and the second hinge respectively include rotating shafts and the rotating shaft of the second hinge is not arranged in an extension line of the rotating shaft of the first hinge such that a coupling portion of the container and the second hinge is drawn forward when the door is rotated independently relative to the container, and wherein the fixing device includes a push unit configured to be pushed by the door and a holder configured to fix the guide unit such that the guide unit becomes a rotation center of the container while the door is rotated and releases the push unit from a pushed state.

The holder may be coupled to the push unit so as to be rotatable relative to the push unit.

The fixing device may include a first holder configured to surround one side of the guide unit and a second holder configured to surround the other side of the guide unit, and the first holder and the second holder may be pivotally rotatable when the push unit is pushed.

The first holder and the second holder may be rotatable to be farther apart from each other.

The guide unit may include a guide pin configured to be surrounded by the first holder and the second holder and a pivotally rotatable guide bar configured to come into contact with the second holder so as to be rotated under guidance of the second holder.

The fixing device may further include a first stopper configured to selectively limit pivotal rotation of the first holder, and the first stopper may be rotated when the push unit is pushed.

The fixing device may further include a second stopper configured to selectively limit pivotal rotation of the second holder, and the second stopper may be rotated when the push unit is pushed.

The first stopper and the second stopper may be rotatable to be farther apart from each other.

The holder may be provided with a guide piece, the guide piece including two parallel guide walls to guide a movement path of the guide unit.

The guide piece may have one open end.

The push unit may include a pressure piece configured to come into contact with the door and be selectively pushed by the door and a transfer piece having a receiving bore in which a cam included in the holder is received and operated.

The receiving bore may be provided with a seat groove, the cam may be provided with a first protrusion, and rotation of the holder may be limited when the first protrusion is received in the seat groove.

The receiving bore may be provided with a stepped seat portion, the cam may be provided with a second protrusion, and rotation of the holder may be limited when the second protrusion is caught by the stepped seat portion.

Advantageous Effects of Invention

In a refrigerator according to the present invention as described above, since only a single door is provided to open or close a storage compartment, it is possible to reduce loss of cold air caused through use of two gaskets and to reduce power consumption by heaters. This may result in enhanced energy efficiency.

In addition, according to the present invention, a container and a door may be operated individually or together, which may facilitate user access to a storage compartment. Moreover, according to the present invention, it is possible to facilitate user access to food received in the container.

In addition, according to the present invention, the container may be fixed to a cabinet when the door except for the container is operated alone. This may prevent unintentional rotation of the container. That is, it is possible to prevent the container from being operated contrary to the user's expectations.

In addition, according to the present invention, the container may be moved in a given direction toward a user when a door is operated alone, which may ensure easier user access to the container.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view showing a state in which a door closes a storage compartment of a refrigerator according to the present invention;

FIG. 2 is a view showing a rotated state of the door in the refrigerator according to the present invention;

FIG. 3 is a view showing a rotated state of a container and the door in refrigerator according to the present invention;

FIG. 4 is a view showing a fixing device according to one embodiment of the present invention, which is installed to the container;

FIG. 5 is a schematic view showing pivotal rotation of the door according to one embodiment of the present invention;

FIG. 6 is a view showing one embodiment of portion 'A' of FIG. 3 in detail;

FIG. 7 is a view showing the fixing device according to one embodiment;

FIG. 8 is a left side view of FIG. 7;

FIG. 9 is a right side view of FIG. 7;

FIG. 10 is an exploded perspective view of FIG. 7;

FIG. 11 is a view showing operation of a guide unit and the fixing device in the state of FIG. 1 according to one embodiment;

FIG. 12 is a view showing operation of the guide unit and the fixing device in the state of FIG. 2 according to one embodiment;

FIG. 13 is a view showing operation of the guide unit and the fixing device in the state of FIG. 3 according to one embodiment;

FIG. 14 is a view showing transition from the state of FIG. 13 to the state of FIG. 11 in sequence;

FIG. 15 is a view showing a fixing device according to another embodiment of the present invention, which is installed to the container;

FIG. 16 is a schematic view showing pivotal rotation of the door according to another embodiment of the present invention;

FIG. 17 is a view showing another embodiment of portion 'A' of FIG. 3 in detail;

FIG. 18 is a view showing the fixing device according to another embodiment;

FIG. 19 is a left side view of FIG. 18;

FIG. 20 is a right side view of FIG. 18;

FIG. 21 is an exploded perspective view of FIG. 18;

FIG. 22 is a view explaining operation of a push unit, a cam and a receiving bore according to another embodiment;

FIG. 23 is a view showing operation of the guide unit and the fixing device in the state of FIG. 1 according to another embodiment;

FIG. 24 is a view showing operation of the guide unit and the fixing device in the state of FIG. 2 according to another embodiment; and FIG. 25 is a view showing operation of the guide unit and the fixing device in the state of FIG. 3 according to another embodiment.

BEST MODE FOR CARRYING OUT THE INVENTION

Hereinafter, preferred embodiments of the present invention to concretely achieve the above-described objects will be described with reference to the accompanying drawings.

The size, shape or the like of components shown in the drawings may be exaggerated for clarity and convenience of description. In addition, the terms, particularly defined by taking into consideration the configurations and functions of the present invention, may be replaced by other terms based on intensions of users or operators or customs. Hence, the meanings of these terms must follow definitions described in the entire specification.

FIG. 1 is a view showing a state in which a door closes a storage compartment of a refrigerator according to the present invention. A description with reference to FIG. 1 is as follows.

A door 20 is installed to a cabinet 10 of the refrigerator. The door 20 may be a door to open a refrigerating compartment or a freezing compartment.

The storage compartment may refer to a first storage region in which food is stored.

A dispenser 30 may be installed in the door 20 to provide a user with water or ice. The user may acquire water or ice via the dispenser 30 without opening the door 20.

The door 20 is provided with a handle 22 to assist the user in pivotally rotating the door 20 with the hand. As the user who grips the handle 22 pivotally rotates the door 20, the storage compartment may be opened.

The handle 22 may be provided with a button 652 that the user can push. The user may execute various functions, such as door opening of the refrigerator and the like, by pushing the button 652. In this case, the button 652 may be used to drive a fastening device that will be described hereinafter.

A button member housing 654 may be formed at one surface of the handle 22 so as to be connected to the interior of the door 20. The button member housing 654 may contain a push bar therein to enable transmission of displacement, generated by the button 652, to the interior of the door 20.

FIG. 2 is a view showing a rotated state of the door in the refrigerator according to the present invention. A description with reference to FIG. 2 is as follows.

Referring to FIG. 2, the door 20 is pivotally rotated alone and a container 100 pivotally rotatably coupled to the door 20 is received in the storage compartment 2.

The storage compartment 2 in which food may be stored is defined in the cabinet 10. The storage compartment 2 may correspond to a refrigerating compartment or a freezing compartment. The user may pivotally rotate the door 20 to open or close the storage compartment 2.

The door 20 is pivotally rotatably coupled to the cabinet 10 via a first hinge 40. The first hinge 40 is connected to one lateral side of the cabinet 10 and one lateral side of the door 20 to assist the door 20 in being pivotally rotated relative to the cabinet 10.

A gasket 26 is attached to an inner surface of the door 20 so as to selectively come into contact with the cabinet 10. The gasket 26 is arranged along an outer circumferential surface of the door 20. As such, the entire gasket 26 may have a rectangular shape conforming to a rectangular shape of the door 20. Once the door 20 is rotated toward the cabinet 10 to hermetically seal the storage compartment 2, the gasket 26 comes into contact with the cabinet 10 to hermetically seal the storage compartment 2.

The door 20 may be provided at an inner surface thereof with at least one storage member 24 in which food is stored. More specifically, after opening the door 20 as exemplarily shown in FIG. 2, the user can access the storage member 24 to store food in the storage member 24 installed to the inner surface of the door 20 or to retrieve the stored food.

The container 100 is pivotally rotatably coupled to the door 20 via a second hinge 200. The second hinge 200 is rotated about a rotating shaft thereof and the rotating shaft of the second hinge 200 is separate from a rotating shaft of the first hinge 40. In this case, the rotating shaft of the second hinge 200 is pivotally rotatably coupled to the door 20.

That is, both the first hinge 40 and the second hinge 200 are coupled to the door 20 without a connection structure therebetween.

The fastening device 600 includes one or more components installed to the door 20 and one or more components installed to the container 100. The fastening device 600 may selectively couple the container 100 and the door 20 to each other or release coupling of the container 100 and the door 20.

As one component installed to the container 100, the fastening device 600 includes a fastener 610. In addition, as components installed to the door 20, the fastening device 600 includes a holder 630 configured to be coupled to the fastener 610 and an operator 640 configured to operate the fastener 610 so as to release coupling of the fastener 610 and the holder 630.

The user may select whether to rotate the container 100 and the door 20 together or to rotate the door 20 alone by selectively operating the button 652 formed at the handle 22. That is, the user may operate the button 652 to rotate the door 20 alone while allowing the container 100 to be received and fixed in the storage compartment 2 as exemplarily shown in FIG. 2.

Meanwhile, the holder 630 is placed in an inner space defined by the gasket 26. The gasket 26 may generally have a rectangular shape similar to the profile of the outer circumferential surface of the door 20 and some components of the fastening device 600 may be arranged inside the rectangular gasket 26.

In addition, the holder 630 and the fastener 610 may be arranged in a region of the storage compartment 2 defined inside the gasket 26. That is, once the door 20 hermetically seals the storage compartment 2, the fastening device 600 is placed in a space of the storage compartment 2 inside the gasket 26. As such, the fastening device 600 may be located in the storage compartment 2 into which cold air is supplied.

Likewise, the fastener 610 may be placed in the space inside the gasket 26, i.e. in a region of the storage compartment 2 inside the gasket 26, although the fastener 610 is installed to the container 100.

Meanwhile, the fastening device 600 may be located at a position opposite to an installation position of the second hinge 200. More specifically, the container 100 may be rotated relative to the door 20 about the second hinge 200 and the fastening device 600 may be positioned far from a rotation center corresponding to the second hinge 200. As the fastening device 600 is located far from the second hinge 200 as a rotation center, the fastening device 600 may stably maintain coupling of the container 100 and the door 20 even with relatively low force.

Meanwhile, a fixing device 500 is installed to the top of the container 100 to fix the container 100 to the cabinet 10.

FIG. 3 is a view showing a rotated state of the container and the door in refrigerator according to the present invention. A description with reference to FIG. 3 is as follows.

Referring to FIG. 3, the door 20 and the container 100 are rotated together to open the storage compartment 2.

The container 100 may be provided with a plurality of storage members 52 to allow the user to store food in the storage members 52 or to retrieve food stored in the storage members 52. The plural storage members 52 may be installed to the container 100 at different heights. The container 100 may internally define a second storage region in which food is stored.

Meanwhile, the user may rotate the container 100 when it is desired to use the storage members 52 installed to the container 100. As the container 100 is rotated and moved outward of the storage compartment 2, the user can access the storage members 52.

Even in a state in which the container 100 comes into contact with the door 20, the gasket 26 does not come into contact with the container 100. That is, the gasket 26 is installed to the door 20 at a position around an outer circumferential surface of the container 100 and, therefore, interference between the gasket 26 and the container 100 does not occur.

Accordingly, even in a state in which the door 20 hermetically seals the storage compartment 2, there occurs no contact between the container 100 and the gasket 26. In this case, the gasket 26 may come into contact with the cabinet 10.

More specifically, in a state as exemplarily shown in FIG. 1, the door 20 and the cabinet 10 are arranged to face each other with the gasket 26 interposed therebetween and, therefore, the storage compartment 2 may be hermetically sealed from the outside by the gasket 26 and the door 20.

In this way, according to the present invention, only the gasket 26 for the door 20 is provided without a gasket for the container 100. That is, the storage compartment 2 may be sufficiently hermetically sealed under provision of the single gasket 26 for the door 20, which may prevent loss of cold air due to installation of several gaskets and waste of power for heating.

Meanwhile, a plurality of shelves 4 on which food can be disposed may be installed in the storage compartment 2 at different heights.

In addition, a plurality of drawers 6 configured to be introduced or withdrawn in a sliding manner may be accommodated in the storage compartment 2. The drawers 6 may allow food received therein to remain hermetically sealed at a given degree even if the storage compartment 2 is opened by pivotal rotation of the door 20 or the container 100.

The container 100 is provided with the fixing device 500 to selectively couple the container 100 to the cabinet 10. The fixing device 500 is configured to be fixed to an inner surface of the cabinet 10, i.e. to a ceiling surface of the storage compartment 2. The user may rotate the door 20 alone or rotate the door 20 and the container 100 together according to user convenience.

More specifically, when the container 100 is fixed to the cabinet 10 by the fixing device 500, the door 20 is pivotally rotated alone. On the other hand, when the container 100 is not fixed to the cabinet 10, the container 100 may be rotated along with the door 20 to open the storage compartment 2.

In FIG. 3, although not shown, a guide unit that will be described later with reference to FIG. 6 or FIG. 17 is installed inside a circular portion designated by reference letter "A". The guide unit will be described later in detail with reference to FIG. 6 or FIG. 17.

FIG. 4 is a view showing the fixing device according to one embodiment of the present invention, which is installed to the container. In addition, in FIG. 4, only the fastener 610 is shown as being separated from the container 100. A description with reference to FIG. 4 is as follows.

The container 100 includes a body 110 forming an external appearance of the container 100 and a cover 130 coupled to the body 110. The cover 130 closes an opening of the body 110 to prevent an inner region of the body 110 from being partially exposed outward.

Meanwhile, the fastening device 600 may be mounted to the cover 130. In this case, as components installed to the container 100, the fastening device 600 may include the fastener 610 and a cover 612 configured to cover the front of the fastener 610.

The fastener 610 and the cover 612 are installed to the container 100 so as to come into contact with the door 20.

The fixing device 500 may be installed to the top of the body 110. The fixing device 500 may selectively come into contact with an inner ceiling surface of the storage compartment 2 to selectively fix the container 100 to the storage compartment 2.

The second hinge 200 may include a rotating shaft 206 coupled to the door 20. The rotating shaft 206 is pivotally rotatably fixed to the door 20 to assist the container 100 in being pivotally rotated about the rotating shaft 206.

Meanwhile, a total of two second hinges 200 may be installed at upper and lower positions of the container 100 respectively. The second hinges 200 have the same shape and differ only in terms of installation positions thereof at the container 100 and the door 20.

FIG. 5 is a schematic view showing pivotal rotation of the door according to one embodiment of the present invention. A description with reference to FIG. 5 is as follows.

In FIG. 5, (a) shows a state in which the door 20 hermetically seals the storage compartment 2 as exemplarily shown in FIG. 1 and the door 20 and the container 100 are located adjacent to each other.

Although a second hinge exemplarily shown in FIG. 5 is an alteration of the above-described second hinge, the second hinge of FIG. 5 may be equal to the above-described second hinge within the scope of the present invention. Thus, the alteration of the above-described second hinge is also referred to as the second hinge.

In a state in which the door 20 is located at the front of the container 100, the container 100 is placed so as to be slightly tilted. More specifically, as exemplarily shown in (a) of FIG. 5, it will be appreciated that, on the basis of one surface of the door 20, the right side of the container 100 may be located farther from the door 20 than the left side of the container 100.

The fixing device 500 is located at the left side of the container 100.

In FIG. 5, (b) shows a state in which the door 20 is rotated alone as exemplarily shown in FIG. 2 and the door 20 and the container 100 are spaced apart from each other.

In this case, when the door 20 is rotated alone, the container 100 remains fixed to the cabinet 10 by the fixing device 500. However, differently from the state as exemplarily shown in (a) of FIG. 5, the container 100 is horizontally oriented rather than being tilted and is drawn toward the user by a predetermined distance.

That is, once the user rotates the door 20, the container 100 is moved toward the user and, therefore, the user can easily access the container 100.

This movement of the container 100 is possible because a rotating shaft 42 of the first hinge 40 and the rotating shaft 206 of the second hinge 200 are located at different positions. In other words, centers of the rotating shaft 42 of the first hinge 40 and the rotating shaft 206 of the second hinge 200 are not present in the same line. That is, since the rotating shaft 42 of the first hinge 40 and the rotating shaft 206 of the second hinge 200 are arranged parallel to each other at different positions when viewed from the top, once the door 20 is rotated relative to the cabinet 10, the container 100 must be rotated under the influence of rotation of the door 20. This is because the container 100 is pivotally rotatably connected to the door 20 via the second hinge 200 and the rotating shaft 206 of the second hinge 200 is rotated relative to the rotating shaft 42 of the first hinge 40 when the door 20 is rotated.

Meanwhile, it will be appreciated that the fixing device 500 is moved downward in the state as exemplarily shown in (b) of FIG. 5 beyond a position as shown in (a) of FIG. 5. The fixing device 500 is installed to the container 100 that is moved upon rotation of the door 20 and, thus, the fixing device 500 is moved simultaneously with rotation of the door 20.

In the state as exemplarily shown in (b) of FIG. 5, the fixing device 500 may remain caught by the cabinet 10 and, therefore, the container is not rotated along with the door 20. This will be described later in detail.

FIG. 6 is a view showing one embodiment of portion 'A' of FIG. 3 in detail. A description with reference to FIG. 6 is as follows.

A guide unit 12 is installed to the top of the cabinet 10 to protrude inward of the storage compartment 2. In this case, the guide unit 12 may protrude downward from the top of the cabinet 10.

The guide unit 12 may include a guide pin 14 in the form of a cylinder. The guide pin 14 is fixed at a predetermined position rather than being movable within the cabinet 10.

The guide pin 14 may have a predetermined thickness and, thus, achieve a given level of strength. Accordingly, as the guide pin 14 comes into contact with the fixing device 500, the guide pin 14 may be moved by the fixing device 500 or movement of the guide pin 14 may be limited by the fixing device 500.

The guide pin 14 may generally take the form of a cylinder having a circular cross section. Of course, the guide pin 14 may be altered into various other shapes.

In addition, the guide unit 12 may include a pivotally rotatable guide bar 15. The guide bar 15 may be rotated about a rotation center at one side thereof. A spring 16 is provided to return the guide bar 15, which has been displaced upon receiving external force, to an original position thereof upon removal of the external force.

A detent boss 18 is formed at one side of the guide bar 15 to prevent the guide bar 15 from being rotated beyond a specific angle. The detent boss 18 may come into contact with the guide bar 15 or may not come into contact with the guide bar 15 according to a position of the guide bar 15.

The detent boss 18 may have a predetermined thickness to limit rotation of the guide bar 15.

Meanwhile, the guide bar 15 may be spaced apart from the guide pin 14 by a predetermined distance. That is, the guide bar 15 and the guide pin 14 may be arranged so as not to come into contact with each other and serve to guide operation of the fixing device 500.

FIG. 7 is a view showing the fixing device according to one embodiment, FIG. 8 is a left side view of FIG. 7, FIG. 9 is a right side view of FIG. 7 and FIG. 10 is an exploded perspective view of FIG. 7. A description with reference to FIGS. 7 to 10 is as follows.

The fixing device 500 may be selectively coupled to or released from the guide unit 12. In addition, the fixing device 500 may be installed to the top of the container 100. This position of the fixing device 500 is determined to ensure contact between the fixing device 500 and the guide unit 12.

The fixing device 500 may include a first holder 510 surrounding one side of the guide unit 12 and a second holder 520 surrounding the other side of the guide unit 12. More specifically, the first holder 510 may be located to surround one side of the guide pin 14 and the second holder 520 may be located to surround the other side of the guide pin 14.

The fixing device 500 includes a housing 502 installed to the body 110. The first holder 510 and the second holder 520 are installed to the housing 502. Meanwhile, the first holder 510 and the second holder 520 are rotatably installed to the housing 502.

The first holder 510 may be provided with a first seat surface 512 that substantially comes into contact with the guide pin 14. The first seat surface 512 may be formed of a shock absorbing material to prevent breakage thereof or to endure shock due to frequent contact with the guide pin 14.

The first holder 510 has a first rotating shaft 518 that is a rotation center of the first holder 510. The first rotating shaft 518 is inserted into a first hole 504 formed in the housing 502. The first hole 504 may have a circular shape.

A first holder fixing piece 514 is fixed to one end of the first rotating shaft 518 to fix the first holder 510 so as not to be separated from the first hole 504.

The other end of the first rotating shaft 518 and one end of the first holder fixing piece 514 have a greater cross section than a cross section of the first hole 504. As such, it is possible to prevent the end of the first holder fixing piece 514 or the first rotating shaft 518 from being separated from the first hole 504 and to stably fix the first holder 510.

The first holder 510 may be rotated about the first hole 504, i.e. the first rotating shaft 518.

Meanwhile, a first elastic member 519 is provided to apply restoration force to the first holder 510 such that the first holder 510 returns to an original position thereof when no external force is applied to the first holder 510. One end of the first elastic member 519 may be fixed to the first holder 510 and the other end of the first elastic member 519 may be fixed to the housing 502.

The first holder 510 has a first insert piece 516 protruding therefrom at a position opposite to the first rotating shaft 518. The first insert piece 516 may extend downward from the first holder 510 by a predetermined length.

The housing 502 is provided with a first stopper 560 to selectively limit rotation of the first holder 510. The first stopper 560 may be fixed in a pivotally rotatable manner by a spring 564. Thus, the first stopper 560 may return to an original position thereof by elastic restoration force of the spring 564 when no external force is applied thereto.

The first stopper 560 includes a first extension member 562 extending downward therefrom. The first extension member 562 may come into contact with a push unit 550 that will be described later to operate the first stopper 560. The first extension member 562, i.e. a lower portion of the first stopper 560 may have a different shape from that of an upper portion of the first stopper 560 so as to come into contact with the push unit 550.

The first stopper 560 is disposed on the housing 502 so as to selectively come into contact with the first insert piece 516.

The second holder 520 may have a second seat surface 521 that substantially comes into contact with the guide pin 14. The second seat surface 521 may be formed of a shock absorbing material to prevent breakage thereof or to endure shock due to frequent contact with the guide pin 14.

The second holder 520 has a second rotating shaft 528 that is a rotation center of the second holder 520. The second rotating shaft 528 is inserted into a second hole 506 formed in the housing 502. The second hole 506 may have a circular shape.

A second holder fixing piece 522 is fixed to one end of the second rotating shaft 528 to fix the second holder 520 so as not to be separated from the second hole 506.

The other end of the second rotating shaft 528 and one end of the second holder fixing piece 522 have a greater cross section than a cross section of the second hole 506. As such, it is possible to prevent the end of the second holder fixing piece 522 or the second rotating shaft 528 from being separated from the second hole 506 and to stably fix the second holder 520.

The second holder 520 may be rotated about the second hole 506, i.e. the second rotating shaft 528.

Meanwhile, a second elastic member 529 is provided to apply restoration force to the second holder 520 such that the second holder 520 returns to an original position thereof when no external force is applied to the second holder 520. One end of the second elastic member 529 may be fixed to the second holder 520 and the other end of the second elastic member 529 may be fixed to the housing 502.

The second holder 520 has a second insert piece 526 protruding thereform at a position opposite to the second rotating shaft 528. The second insert piece 526 may extend downward from the second holder 520 by a predetermined length.

The housing 502 is provided with a second stopper 570 to selectively limit rotation of the second holder 520. The second stopper 570 may be fixed in a pivotally rotatable manner by a spring 574. Thus, the second stopper 570 may return to an original position thereof by elastic restoration force of the spring 574 when no external force is applied thereto.

The second stopper 570 includes a second extension member 572 extending downward therefrom. The second extension member 572 may come into contact with the push unit 550 that will be described later to operate the second stopper 570. The second extension member 572 may have a different shape from that of an upper portion of the second stopper 570 so as to come into contact with the push unit 550.

The second stopper 570 is disposed on the housing 502 so as to selectively come into contact with the second insert piece 526.

The first holder 510 and the second holder 520 may be arranged such that the first seat surface 512 and the second seat surface 521 face each other. That is, the first holder 510 and the second holder 520 may be temporarily arranged parallel to each other.

In particular, the first holder 510 and the second holder 520 are individually installed to the housing 502 and, therefore, may be rotated independently of each other. This is because rotation of the first holder 510 has no effect on the second holder 520.

Similarly, the first stopper 560 and the second stopper 570 may be arranged at the housing 502 so as to face each other. Of course, the first stopper 560 and the second stopper 570 are installed to the housing 502 so as to be rotatable independently of each other.

Meanwhile, the fixing device 500 includes the push unit 550 penetrating the housing 502.

The push unit 550 may include a pressure piece 552 configured to come into contact with the door 20 so as to be selectively pressed by the door 20, connector pieces 554 extending from the pressure piece 552 to penetrate the container 100 and a transfer piece 556 coupled to the connector pieces 554 to transfer force required to pivotally rotate the stopper 560.

More specifically, a portion of the pressure piece 552 is exposed outward of the container 100. In this case, the pressure piece 552 may have a greater cross section that a cross section of the connector pieces 554. As such, a contact area between the pressure piece 552 and the door 20 may be increased and, consequently, the pressure piece 552 may be pressed at an increased area by the door 20 when coming into contact with the door 20.

A portion of each connector piece 554 may be received in the container 100 and the connector piece 554 may serve to transfer force from the pressure piece 552 to the transfer piece 556.

The connector pieces 554 take the form of two rods and are coupled respectively at one end thereof to the pressure piece 552. Through this configuration, force applied to the pressure piece 552 may be distributed to the two connector pieces 554, which may ensure stable transfer of force.

The connector piece 554 and the transfer piece 556 may be connected to each other via screwing, for example.

The push unit 550 may be moved in a front-and-rear direction relative to the housing 502. Meanwhile, a spring may be installed to the push unit 550 to return the push unit 550 to an original position thereof when no external force is applied to the push unit 550 and to limit operation of the push unit 550.

The transfer piece 556 has a first raised surface portion 557 and a second raised surface portion 558 which protrude more than the remaining portion of the transfer piece 556. The first raised surface portion 557 may selectively come into contact with the first extension member 562 of the first stopper 560 and the second raised surface portion 558 may selectively come into contact with the second extension member 572 of the second stopper 570.

The first raised surface portion 557 and the second raised surface portion 558 may be formed respectively at opposite sides of the transfer piece 556.

Meanwhile, one end of the first raised surface portion 557 and one end of the second raised surface portion 558 may be inclined to provide a portion of the transfer piece 556 with a reduced width. As such, the transfer piece 556 may have a greater width at the first raised surface portion 557 and the second raised surface portion 558 than a width of the remaining portion of the transfer piece 556.

FIG. 11 is a view showing operation of the guide unit and the fixing device in the state of FIG. 1 according to one embodiment. A description with reference to FIG. 11 is as follows.

When the door 20 hermetically seals the storage compartment 2 as exemplarily shown in FIG. 1, the container 100 is positioned as exemplarily shown in FIG. 2. In this case, the container 100 is completely covered with the door 20 and is invisible from the outside in the state of FIG. 1. In addition, in such a state, the container 100 and the door 20 come into contact with each other.

Accordingly, the door 20 applies force to push the pressure piece 552. As the pressure piece 552 is pushed, the first extension member 562 of the first stopper 560 comes into contact with the first raised surface portion 557 and the second extension member 572 of the second stopper 570 comes into contact with the second raised surface portion 558.

The first raised surface portion 557 and the second raised surface portion 558 are portions protruding outward from the center of the transfer piece 556 and, therefore, may serve to vary rotation angles of the first stopper 560 and the second stopper 570.

More specifically, the first stopper 560 is rotated clockwise by a predetermined angle from an original position thereof so as not to be caught by the first insert piece 516.

In addition, the second stopper 570 is rotated clockwise by a predetermined angle from an original position thereof so as not to be caught by the second insert piece 526.

The first stopper 560 and the second stopper 570 are rotated in a direction away from each other by the transfer piece 556.

That is, the first holder 510 and the second holder 520 are no longer fixed by the first stopper 560 and the second stopper 570.

The first holder 510 and the second holder 520 may be rotated when force required to allow the first holder 510 and the second holder 520 to overcome elastic force of the first elastic member 519 and the second elastic member 529 is applied thereto.

In this way, the fixing device 500 is released from the guide unit 12. However, in such a state, although the container 100 is not fixed to the cabinet 10, rotation of the container 100 is impossible because the door 20 comes into contact with the container 100 and prevents movement of the container 100.

In particular, the first holder 510 is rotated counterclockwise by the guide pin 14. That is, in a state in which the door 20 hermetically seals the storage compartment 2, the first holder 510 is rotated toward the container 100 by a predetermined angle. In this case, to allow the first holder 510 to be rotated counterclockwise, the housing 502 and the first holder 510 may be installed to maintain a constant distance therebetween.

In the state as exemplarily shown in FIG. 11, the first holder 510 is rotated and the second holder 520 remains stationary. That is, any one of the first holder 510 and the second holder 520 may be rotated.

FIG. 12 is a view showing operation of the guide unit and the fixing device in the state of FIG. 2 according to one embodiment. A description with reference to FIG. 12 is as follows.

To access the container 100 from the front side of the container 100 or to access food stored inside the door 20, the user may rotate the door 20 alone as exemplarily shown in FIG. 2. In this case, the container 100 remains fixed to the cabinet 10.

When the user rotates the door 20 alone while remaining the container 100 stationary, as exemplarily shown in FIG. 11, the door 20 no longer applies push force to the pressure piece 552. In this case, the user may use the above-described fastening device 600.

When the door 20 is rotated alone, the door 20 is moved away from the container 100 and no longer applies force to the pressure piece 552.

Accordingly, the first raised surface portion 557 does not come into contact with the first extension member 562 of the first stopper 560. Likewise, the second raised surface portion 558 does not come into contact with the second extension member 572 of the second stopper 570.

The first stopper 560 and the second stopper 570 respectively come into contact with a narrower portion of the transfer piece 556 than the first raised surface portion 557 and the second raised surface portion 558. That is, as compared to FIG. 11, the first stopper 560 and the second stopper 570 are rotated counterclockwise so as to be located close to each other.

Accordingly, the first stopper 560 may be caught by the first insert piece 516, thus serving to limit rotation of the first holder 510. Likewise, the second stopper 570 may be caught by the second insert piece 526, thus serving to limit rotation of the second holder 520.

Since rotation of both the first holder 510 and the second holder 520 is impossible, the fixing device 500 is fixed to the guide pin 14. Thus, the container 100 is fixed to the cabinet 10.

Meanwhile, in the state of FIG. 12, the guide pin 14 may come into contact with the first seat surface 512 and the second seat surface 521.

In conclusion, when the user rotates the door 20 alone by the fastening device 600 in the state of FIG. 11, the fixing device 500 is positioned to couple the container 100 to the cabinet 10. In this way, the container 100 may remain coupled to the cabinet 10 in a pivotally rotated state of the door 20.

FIG. 13 is a view showing operation of the guide unit and the fixing device in the state of FIG. 3 according to one embodiment. A description with reference to FIG. 13 is as follows.

The user may simultaneously rotate the container 100 and the door 20 as exemplarily shown in FIG. 3.

In this case, in the state as exemplarily shown in FIG. 11, the door 20 and the container 100 are rotated together. This is because the door 20 and the container 100 are rotated relative to the cabinet 10 by the first hinge 40 while maintaining a distance between the door 20 and the container 100. To simultaneously rotate the door 20 and the container 100, the user may operate the fastening device 600 in the above-described manner. Operation of the fastening device 600 will not be described hereinafter.

In the state of FIG. 11, the fixing device 500 does not fix the container 100 to the cabinet 10. That is, the second holder 520 is not engaged with the second stopper 570. Thus, the second holder 520 may be rotated counterclockwise upon receiving relatively low force required to allow the second holder 520 to overcome elastic restoration force of the second elastic member 529.

In this case, the second holder 520 may be rotated counterclockwise as the door 20 and the container 100 are moved downward because the guide pin 14 is integrated with the cabinet 10 and remains stationary. In this case, the second holder 520 comes into contact with the guide pin 14 and is sufficiently rotated counterclockwise by the guide pin 14. In particular, when the second holder 520 is sufficiently rotated, the second holder 520 no longer comes into contact with the guide pin 14.

That is, the fixing device 500 is not fixed to the guide pin 14 and, therefore, the user may rotate the door 20 and the container 100 relative to the cabinet 10 to access food stored in the storage compartment 2.

Of course, in a state in which the container 100 and the door 20 have been sufficiently rotated relative to the cabinet 10 as exemplarily shown in FIG. 3, the second holder 520 must be further rotated counterclockwise beyond what is shown in FIG. 13. In addition, the guide pin 14 is located far from the fixing device 500.

FIG. 14 is a view showing transition from the state of FIG. 13 to the state of FIG. 11 in sequence. A description with reference to FIG. 14 is as follows.

The user must rotate the door 20 and the container 100 to the state as exemplarily shown in FIG. 1 after retrieving food stored in the storage compartment 2 or inserting food into the storage compartment 2.

In this case, in a state in which the container 100 and the door 20 are rotated together as exemplarily shown in FIG. 3, the second holder 520 remains rotated counterclockwise as exemplarily shown in (a) of FIG. 14. This is because the second elastic member 529 cannot apply elastic restoration force to the second holder 520 once the second holder 520 is rotated beyond a given angle. Since the second elastic member 529 cannot provide elastic restoration force, the second holder 520 remains stationary in a counterclockwise rotated state.

When the user rotates the door 20 and the container 100 inward of the storage compartment 2, the second holder 520 comes into contact with the guide bar 15. In this case, as the user gradually rotates the container 100 upward, the second holder 520 successively comes into contact with different portions of the guide bar 15.

In particular, the guide bar 15 is pivotally rotatable and does not apply strong instantaneous force to the second holder 520. That is, when the second holder 520 applies great force to the guide bar 15, the guide bar 15 may be rotated counterclockwise as exemplarily shown in (b) of FIG. 14.

Accordingly, it is possible to prevent the guide bar 15 from being broken by colliding with the second holder 520.

Through gradual transition between the states shown in (c) of FIG. 14 and (d) of FIG. 14, the second holder 520 may be rotated clockwise and be positioned as exemplarily shown in FIG. 11.

FIG. 15 is a view showing a fixing device according to another embodiment of the present invention, which is installed to the container. FIG. 15 differs from FIG. 4 only in terms of the shape of the fixing device 1500 and thus, a description of other configurations will be omitted hereinafter.

FIG. 16 is a schematic view showing pivotal rotation of the door according to another embodiment of the present invention. A description with reference to FIG. 16 is as follows.

In FIG. 16, (a) shows a state in which the door 20 hermetically seals the storage compartment 2 as exemplarily shown in FIG. 1 and the door 20 and the container 100 are located adjacent to each other.

In a state in which the door 20 is located at the front of the container 100, the container 100 is slightly tilted. That is, as exemplarily shown in (a) of FIG. 16, on the basis of one surface of the door 20, the right side of the container 100 may be located farther from the door 20 than the left side of the container 100.

The fixing device 1500 is located at the left side of the container 100.

In FIG. 16, (b) shows a state in which the door 20 is rotated alone as exemplarily shown in FIG. 2 and the door 20 and the container 100 are spaced apart from each other.

In this case, when the door 20 is rotated alone, the container 100 remains fixed to the cabinet 10 by the fixing device 500. However, differently from the state as exemplarily shown in (a) of FIG. 16, the container 100 is horizontally oriented rather than being tilted and is drawn toward the user by a predetermined distance.

That is, once the user rotates the door 20, the container 100 is moved toward the user and, therefore, the user can easily access the container 100.

This movement of the container 100 is possible because the rotating shaft 42 of the first hinge 40 and the rotating shaft 206 of the second hinge 200 are located at different positions. In other words, centers of the rotating shaft 42 of the first hinge 40 and the rotating shaft 206 of the second hinge 200 are not present in the same line. That is, since the rotating shaft 42 of the first hinge 40 and the rotating shaft 206 of the second hinge 200 are arranged parallel to each other at different positions when viewed from the top, once the door 20 is rotated relative to the cabinet 10, the container 100 must be rotated under the influence of rotation of the door 20. This is because the container 100 is pivotally rotatably connected to the door 20 via the second hinge 200 and the rotating shaft 206 of the second hinge 200 is rotated relative to the rotating shaft 42 of the first hinge 40 when the door 20 is rotated.

Meanwhile, it will be appreciated that the fixing device 1500 is moved downward in the state as exemplarily shown in (b) of FIG. 16 beyond a position as shown in (a) of FIG. 16. The fixing device 1500 is installed to the container 100 that is moved upon rotation of the door 20 and, thus, the fixing device 1500 is moved simultaneously with rotation of the door 20.

In the state as exemplarily shown in (b) of FIG. 16, the fixing device 1500 may remain caught by the cabinet 10 and, therefore, the container is not rotated along with the door 20.

FIG. 17 is a view showing another embodiment of portion 'A' of FIG. 3 in detail. A description with reference to FIG. 17 is as follows.

A guide unit 1012 is installed to the top of the cabinet 10 to protrude into the storage compartment 2. In this case, the guide unit 1012 may protrude downward from the top of the cabinet 10.

The guide unit 1012 may include a guide pin 1016 in the form of a cylinder. The guide pin 1016 is fixed at a predetermined position rather than being movable within the cabinet 10.

The guide pin 1016 may have a predetermined thickness and, thus, achieve a given level of strength. Accordingly, as the guide pin 1016 comes into contact with the fixing device 1500, the guide pin 1016 may be moved by the fixing device 1500 or movement of the guide pin 1016 may be limited by the fixing device 1500.

FIG. 18 is a view showing the fixing device according to another embodiment, FIG. 19 is a left side view of FIG. 18, FIG. 20 is a right side view of FIG. 18 and FIG. 21 is an exploded perspective view of FIG. 18. A description with reference to FIGS. 18 to 21 is as follows.

Movement of the fixing device 1500 relative to the guide unit 1012 may be selectively limited. That is, the fixing device 1500 may be movable relative to the guide unit 1012 at a specific position where movement of the fixing device 1500 relative to the guide unit 1012 is permitted, and may be immovable relative to the guide unit 1012 at a specific position where movement of the fixing device 1500 relative to the guide unit 1012 is not permitted.

In addition, the fixing device 1500 may be installed to the top of the container 100. This position of the fixing device 1500 is determined to ensure contact between the fixing device 1500 and the guide unit 1012.

The fixing device 1500 includes a housing 1502 installed to the body 110. The housing 1502 is provided with a plurality of components to allow the fixing device 1500 to come into contact with the guide unit 1012.

The housing 1502 may have a circular hole 1504.

A holder 1510 is installed to the housing 1502 so as to be rotatable relative to the housing 1502. In this case, the holder 1510 may include a rotating shaft 1512 configured to be inserted into the hole 1504 and coupled to a holder fixing piece 1530. As such, the rotating shaft 1512 of the holder 1510 is rotatable in the hole 1504 without a risk of separation from the hole 1504.

The holder 1510 may include a plate 1511 and the rotating shaft 1512 may protrude downward from the plate 1511. The plate 1511 may be rotated about the rotating shaft 1512.

Although the plate 1511 may have a circular shape, the plate 1511 may be altered into various other shapes.

A guide piece 1514 may be formed at an upper surface of the plate 1511 to guide a movement path of the guide pin 1016.

The guide piece 1514 may include two parallel guide walls 1516. A longitudinal space having a predetermined length may be present between the two guide walls 1516 and the guide pin 1016 may be moved between the guide walls 1516. Movement of the guide pin 1016 across the guide walls 1516 rather than movement of the guide pin 1016 along the space between the two guide walls 1516 is impossible. Thus, the guide walls 1516 may serve to limit a movement path of the guide pin 1016.

The guide piece 1514 may have an opening 1518 between ends of the two guide walls 1516. When the guide pin 1016 escapes from the guide piece 1514 through the opening 1518, the fixing device 1500 may no longer have an effect on a movement path of the guide unit 1012.

A first elastic member 1528 is installed to provide the holder 1510 with elastic restoration force required to return the holder 1510 to an original position thereof when force applied to the holder 1510 is removed. One end of the first elastic member 1528 may be coupled to a lower surface of the plate 1511 and the other end of the first elastic member 1528 may be coupled to the housing 1502. As such, the first elastic member 1528 may be stretched when the fixing device 1500 is pressed and, then, may return to an original state thereof when external force pressing the fixing device 1500 is removed.

A cam 1520 is coupled to the rotating shaft 1512 to selectively allow or prevent rotation of the holder 1510. In this case, whether the holder 1510 is rotatable or not rotatable may be determined by a shape of the cam 1520. The cam 1520 is installed to the rotating shaft 1512 so as to be rotated by the same angle as the rotating shaft 1512.

The cam 1520 may have a first protrusion 1522 and a second protrusion 1524 formed at positions opposite to each other. The first protrusion 1522 may be tapered to be reduced in thickness with increasing distance from the rotating shaft 1512 that is located in the center of the cam 1520. The second protrusion 1524 may have a flat end surface and, thus, may come into surface contact with another member.

The cam 1520 may further have a slope 1526 configured to come into contact with a push unit 1550 that will be described later, the slope 1526 serving to guide rotation of the cam 1520. The slope 1526 may be curved to guide continuous rotation of the cam 1520.

The fixing device 1500 includes the push unit 1550 which may be pushed by pressure applied from the door 20. When the door 20 applies pressure to the push unit 1550, the push unit 1550 may be moved linearly.

The push unit 1550 may include a pressure piece 1552 configured to come into contact with and be selectively pushed by the door 20 and a transfer piece 1554 coupled to the pressure piece 1552 to rotate the holder 1510 while linearly moving the holder 1510.

The pressure piece 1552 may be partially received in the container 100 and force applied to the pressure piece 1552 may be transferred to the transfer piece 1554.

The push unit 1550 may be moved in a front-and-rear direction relative to the housing 1502.

The transfer piece 1554 may be coupled to the housing 1502 via a spring 1556. As such, when the transfer piece 1554 is moved away from the housing 1502 upon receiving external force, the spring 1556 is stretched. On the other hand, when external force to urge the transfer piece 1554 away from the housing 1502 is removed, the spring 1556 may return to an original length thereof to maintain a constant distance between the transfer piece 1554 and the housing 1502.

The first elastic member 1528 and the spring 1556 may be deformed by tension and store elastic force as stretched lengths thereof return to original lengths by restoration.

The transfer piece 1554 has a receiving bore 1560 in which the cam 1520 to be coupled to the holder 1510 is received.

In this case, the rotating shaft 1512 of the holder 1510 passes through the hole 1504 and the receiving bore 1560 to thereby be coupled to the holder fixing piece 1530. In particular, the cam 1520 may be engaged with the rotating shaft 1512 and may be rotated simultaneously with rotation of the rotating shaft 1512.

The receiving bore 1560 is selectively provided at an inner circumference thereof with a seat groove 1562 in which the first protrusion 1522 is received and fixed. The seat groove 1562 may have a shape corresponding to a shape of the first protrusion 1522. For example, the seat groove 1562 may have a tapered shape such that a width of the seat groove 1562 is reduced inwardly.

The receiving bore 1560 may have a stepped seat portion 1564 by which the second protrusion 1524 is caught when the cam 1520 is rotated to some extent. The stepped seat portion 1564 may be defined in the receiving bore 1560 and have a predetermined area.

The inner circumference of the receiving bore 1560 may come into contact with the slope 1526 of the cam 1520 and guide the cam 1520 to enable rotation of the cam 1520.

FIG. 22 is a view explaining operation of the push unit, the cam and the receiving bore according to another embodiment. A description with reference to FIG. 22 is as follows.

In FIG. 22, (a) shows a state in which the push unit 1550 is not pushed and (b) to (d) show stepwise push operation of the push unit 1550. That is, a push degree of the push unit 1550 is increased from (b) to (d) of FIG. 22.

As exemplarily shown in (a) of FIG. 22, when the push unit 1550 is not pushed, a spring 1556 remains in an original state thereof rather than being stretched.

In this case, the cam 1520 remains in a fixed state so as not to be rotated because the first protrusion 1522 is inserted in the seat groove 1562. In particular, clockwise rotation as well as counterclockwise rotation of the cam 1520 are impossible because both sides of the first protrusion 1522 are caught by the seat groove 1562.

In the state as exemplarily shown in (a) of FIG. 22, a gap having a length "1" is present between the cam 1520 and the inner circumference of the receiving bore 1560.

As exemplarily shown in (b) of FIG. 22, when the push unit 1550 is pushed, the cam 1520 is moved linearly within the receiving bore 1560. That is, the cam 1520 may be pushed until a lower end of the cam 1520 comes into contact with the inner circumference of the receiving bore 1560 and the gap "1" shown in (a) of FIG. 22 is removed.

In this case, even if the push unit 1550 is moved upward as compared to that in (a) of FIG. 22, the cam 1520 is installed to the housing 1502 and, thus, remains stationary rather than being moved upward along with the push unit 1550. Thereby, the first protrusion 1522 may escape from the seat groove 1562.

In particular, when the push unit 1550 is pushed until it reaches a position where the gap "1" is removed (this position is referred to as the "specific position"), the cam 1520 is moved linearly within the receiving bore 1560 without implementation of rotation. More specifically, since rotation of the cam 1520 occurs simultaneously with rotation of the holder 1510, the holder 1510 is not rotated while the push unit 1550 is being pushed to the specific position.

As the receiving bore 1560 is displaced away from the housing 1502, the spring 1556 may be stretched.

As exemplarily shown in (c) of FIG. 22, as the push unit 1550 is further pushed beyond the specific position shown in (b) of FIG. 22, the slope 1526 comes into contact with the inner circumference of the receiving bore 1560, thereby being rotated.

Owing to the slope 1526 having a curved shape, the cam 1520 may be continuously rotated counterclockwise as the push unit 1550 is pushed. This is because the holder 1510 is installed to the housing 1502 and, thus, the cam 1520 installed to the holder 1510 cannot be moved relative to the housing 1502 even if the push unit 1550 is pushed. Accordingly, linear movement of the push unit 1550 causes rotation of the cam 1520.

That is, when the push unit 1550 is further pushed beyond the specific position, the cam 1520 begins to rotate. In this case, the specific position may refer to a state in which the push unit 1550 is pushed such that the cam 1520 and the receiving bore 1560 meet each other.

As exemplarily shown in (d) of FIG. 22, as the push unit 1550 is further pushed, the second protrusion 1524 comes into contact with the stepped seat portion 1564 after the cam 1520 is sufficiently rotated counterclockwise. Since the second protrusion 1524 has one flat surface and, likewise, the stepped seat portion 1564 has one flat surface, rotation of the cam 1520 may stop when the second protrusion 1524 comes into contact with the stepped seat portion 1564.

That is, once the push unit 1550 is pushed to reach a position as exemplarily shown in (d) of FIG. 22, the push unit 1550 is no longer pushed and, thus, rotation of the holder 1510 may stop.

FIG. 23 is a view showing operation of the guide unit and the fixing device in the state of FIG. 1 according to another embodiment. In FIG. 23, (a) is a top plan view and (b) is a detailed view showing an inner configuration. A description with reference to FIG. 23 is as follows.

When the door 20 hermetically seals the storage compartment 2 as exemplarily shown in FIG. 1, the container 100 is located at a position as exemplarily shown in FIG. 2. In this case, the container 100 is completely covered with the door 20 and is invisible in the state of FIG. 1. In addition, the container 100 and the door 20 come into contact with each other.

Accordingly, the pressure piece 1552 is pushed by the door 20. As the pressure piece 1552 is pushed, the holder 1510 is rotated, thus causing the guide piece 1514 to be rotated. In this case, the cam 1520 is positioned as exemplarily shown in (d) of FIG. 22 and positions of other inner components of the fixing device 500 are equal to the above description of (d) of FIG. 22.

That is, additional counterclockwise rotation of the holder 1510 does not occur because the second protrusion 1524 of the cam 1520 comes into contact with the stepped seat portion 1564.

The fixing device 1500 cannot limit movement of the guide unit 1012. That is, the guide pin 1016 may be moved between the guide walls 1516.

However, in such a state, although the container 100 is not fixed to the cabinet 10, the door 20 comes into contact with the container 100, thereby preventing movement of the container 100. Thus, rotation of the container 100 is impossible.

FIG. 24 is a view showing operation of the guide unit and the fixing device in the state of FIG. 2 according to another embodiment. In FIG. 24, (a) is a top plan view and (b) is a detailed view showing an inner configuration. A description with reference to FIG. 24 is as follows.

The user may rotate the door 20 alone as exemplarily shown in FIG. 2 to access the container 100 through the front of the container 100 or to access food stored inside the door 20. In this case, the container 100 remains fixed to the cabinet 10.

When the user rotates the door 20 alone in a stationary state of the container 100, as exemplarily shown in FIG. 23, push force applied from the door 20 to the pressure piece 1552 is removed. In this case, the user may use the above-described fastening device 600.

When the door 20 is rotated alone, a distance between the container 100 and the door 20 is increased and force applied to the pressure piece 1552 is removed and, therefore, external force applied to the first elastic member 1528 and the spring 1556 is removed. As such, the first elastic member 1528 and the spring 1556 exert elastic restoration force to return to original shapes thereof.

Accordingly, the holder 1510 is rotated clockwise in the state shown in FIG. 23. That is, the holder 1510 is operated in an inverse sequence of that shown in FIG. 22. That is, as the cam 1520 is rotated clockwise and thereafter is again moved upward, the first protrusion 1522 is inserted into and fixed in the seat groove 1562.

Since rotation of the cam 1520, i.e. rotation of the holder 1510 is limited, the holder 1510 remains in a fixed state even if the guide pin 1016 collides with the holder 1510.

As the pressure piece 1552 is moved downward as compared to FIG. 24, a portion of the pressure piece 1552 to be exposed outward may be increased.

The guide pin 1016 is not moved in a front-and-rear direction and remains stationary between the two guide walls 1516 because the guide walls 1516 extend in an approximately horizontal direction. That is, to allow the container 100 to be rotated relative to the cabinet 10, it is necessary to orient the guide walls 1516 in a direction as exemplarily shown in FIG. 23. However, the container 100 may be in a state in which the container 100 is substantially fixed to the cabinet 10 because the guide walls 1516 are arranged in the state of FIG. 24.

In conclusion, when the user rotates the door 20 alone using the fastening device 600 in the state of FIG. 23, the fixing apparatus 1500 is positioned to couple the container 100 to the cabinet 10. In this way, the container 100 may be continuously coupled to the cabinet 10 in a pivotally rotated state of the door 20.

FIG. 25 is a view showing operation of the guide unit and the fixing device in the state of FIG. 3 according to another embodiment. In FIG. 25, (a) is a top plan view and (b) is a detailed view showing an inner configuration. A description with reference to FIG. 25 is as follows.

The user may simultaneously rotate the container 100 and the door 20 as exemplarily shown in FIG. 3. As such, the user can access the storage compartment 2.

In this case, in the state shown in FIG. 23, the door 20 and the container 100 are rotated together. The user rotates the door 20 and the container 100 relative to the cabinet 10 in the state of FIG. 23.

To simultaneously operate the door 20 and the container 100, the user may operate the fastening device 600 in the above-described manner.

When the container 100 and the door 20 are rotated together, the guide pin 1016 passes the space between the two guide walls 1516 and, thereafter, escapes from the guide walls 1516 through the opening 1518.

Even in the state shown in FIG. 23, the guide pin 1016 is not fixed by the fixing device 1500 and, therefore, the user can access food stored in the storage compartment 2 by rotating the container 100 and the door 20 relative to the cabinet 10.

The user must rotate the door 20 and the container 100 to the state as exemplarily shown in FIG. 1 after retrieving food stored in the storage compartment 2 or inserting food into the storage compartment 2.

Once the user rotates the door 20 and the container 100 inward of the storage compartment 2, the pressure piece 1552 is rotated while remaining in a pushed state because the door 20 and the container 100 are rotated together.

Accordingly, the guide pin 1016 enters the space between the two guide walls 1516 through the opening 1518 and, thereafter, is moved between the two guide walls. Of course, the guide pin 1016 is a component fixed to the cabinet 10 and the holder 1510, i.e. the container 100 actually implements movement.

Meanwhile, the state shown in FIG. 23 is equal to the state shown in (d) of FIG. 22 and the second protrusion 1524 is continuously caught by the stepped seat portion 1564.

The present invention should not be construed as limited to the embodiments set forth herein. It should be understood that various modifications can be made by those skilled in the art within the spirit and scope of the invention as defined by the claims and these modifications should not be understood independently of the technical sprit or prospect of the invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet defining a first storage region configured to store food;

a door rotatably connected to the cabinet and configured to open and close the first storage region;

a gasket provided at the door and configured to define a sealing region that seals the first storage region from outside air;

a first hinge provided at an outer side of a sealing region away from the first storage region, a first end of the first hinge being fixedly attached to the cabinet and a second end of the first hinge being rotatably connected to the door;

a container defining a second storage region and configured to rotate relative to the door and relative to the cabinet such that the container is configured to be received within the first storage region of the cabinet;

a second hinge provided at an inner side of the sealing region towards the first storage region, a first end of the second hinge being fixedly attached to the container and a second end of the second hinge being rotatably connected to the door;

a guide unit provided at the cabinet and configured to protrude into the first storage region; and a fixing device provided at the container and configured to be selectively coupled to or released from the guide unit, wherein the first hinge comprises a first rotating shaft and the second hinge comprises a second rotating shaft, and the second rotating shaft of the second hinge is arranged such that an axis of rotation of the second rotating shaft is not collinear with an axis of rotation of the first rotating shaft such that a coupling portion between the container and the second hinge is drawn forward away from the first storage region based on the door being rotated to open the first storage region independently of the container, and wherein the fixing device comprises:

a push unit configured to be pushed into a pushed state by the door based on the door closing the first storage region and to be released from the pushed state based on the door being rotated to open the first storage region; and a holder configured to, in a state in which the door is rotated to open the first storage region and the push unit is released from the pushed state, maintain the guide unit in a fixed position such that the guide unit provides a fixed axis of rotation for the container.

2. The refrigerator according to claim 1, wherein the fixing device is configured such that the holder is coupled to the push unit so as to be rotatable relative to the push unit.

3. The refrigerator according to claim 1, wherein the holder of the fixing device comprises a first holder configured to surround one side of the guide unit and a second holder configured to surround the other side of the guide unit, and wherein the first holder and the second holder are pivotally rotatable based on the push unit being pushed into the pushed state by the door.

4. The refrigerator according to claim 3, wherein at least one of the first holder or the second holder is rotatable such that a distance between the first holder and the second holder increases based on the at least one of the first holder or the second holder being rotated.

5. The refrigerator according to claim 3, wherein the guide unit comprises:

a guide pin configured to be adjacent to the first holder on a first side of the guide pin and adjacent to the second holder on a second side of the guide pin; and a pivotally rotatable guide bar configured to contact the second holder so as to be rotated based on a movement of the second holder.

6. The refrigerator according to claim 3, wherein the fixing device further comprises a first stopper configured to selectively limit a pivotal rotation of the first holder, and wherein the first stopper is configured to be rotated based on the push unit being pushed into the pushed state by the door.

7. The refrigerator according to claim 6, wherein the fixing device further comprises a second stopper configured to selectively limit a pivotal rotation of the second holder, and wherein the second stopper is configured to be rotated based on the push unit being pushed into the pushed state by the door.

8. The refrigerator according to claim 7, wherein the first stopper and the second stopper are each configured to be rotatable such that a distance between the first stopper and the second stopper increases based on at least one of the first stopper or the second stopper being rotated.

9. The refrigerator according to claim 1, wherein the holder is provided with a guide piece that comprises two parallel guide walls configured to guide a movement path of the guide unit.

10. The refrigerator according to claim 9, wherein the guide piece is provided with an open end.

11. The refrigerator according to claim 9, wherein:

the holder comprises a cam configured to transform a linear motion of the push unit into a rotation of the holder, and the push unit comprises:

a pressure piece configured to contact the door and be selectively pushed by the door; and a transfer piece provided with a receiving bore in which the cam included in the holder is received and operated.

12. The refrigerator according to claim 11, wherein the receiving bore is provided with a seat groove, wherein the cam is provided with a first protrusion, and wherein the rotation of the holder is limited based on the first protrusion being received in the seat groove.

13. The refrigerator according to claim 12, wherein the receiving bore is provided with a stepped seat portion, wherein the cam is provided with a second protrusion, and wherein the rotation of the holder is limited based on the second protrusion being caught by the stepped seat portion.

14. The refrigerator according to claim 1, wherein in a state in which the coupling portion between the container and the second hinge is drawn forward away from the first storage region based on the door being rotated to open the first storage region independently of the container:

the container is configured to remain coupled to the cabinet by the fixing device being coupled to the guide unit, the second end of the second hinge that is rotatably connected to the door is configured to move forward away from the first storage region based on the door being rotated to open the first storage region, and the first end of the second hinge that is fixedly attached to the container is configured to pull the coupling portion between the container and the second hinge away from the first storage region.

* * * * *